US010940350B2

(12) United States Patent
Pigeon

(10) Patent No.: US 10,940,350 B2
(45) Date of Patent: Mar. 9, 2021

(54) MULTI-HEAD ARRAY FIRE SPRINKLER SYSTEM FOR STORAGE APPLICATIONS

(71) Applicant: Firebird Sprinkler Company LLC, Ann Arbor, MI (US)

(72) Inventor: Jeffrey J. Pigeon, Ann Arbor, MI (US)

(73) Assignee: Firebird Sprinkler Company LLC, Ann Arbor, MI (US)

( * ) Notice: Subject to any disclaimer, the term of this patent is extended or adjusted under 35 U.S.C. 154(b) by 123 days.

(21) Appl. No.: 16/589,283

(22) Filed: Oct. 1, 2019

(65) Prior Publication Data

US 2020/0030648 A1 Jan. 30, 2020

Related U.S. Application Data

(63) Continuation of application No. 16/208,649, filed on Dec. 4, 2018, now abandoned, which is a (Continued)

(51) Int. Cl.
*A62C 35/68* (2006.01)
*A62C 31/02* (2006.01)
(Continued)

(52) U.S. Cl.
CPC ..... *A62C 35/68* (2013.01); *A62C 3/002* (2013.01); *A62C 31/02* (2013.01); *A62C 35/64* (2013.01);
(Continued)

(58) Field of Classification Search
CPC ..... A62C 3/002; A62C 3/004; A62C 31/02; A62C 35/58; A62C 35/60; A62C 35/62;
(Continued)

(56) References Cited

U.S. PATENT DOCUMENTS 1,667,425 A * 4/1928 Loepsinger ..... A62C 35/605 169/5
1,796,159 A 3/1931 Pallady
(Continued)

FOREIGN PATENT DOCUMENTS

DE 1899279 U 8/1964
DE 112006002211 7/2008
(Continued)

OTHER PUBLICATIONS

Globe Sprinkler, Specific Application Attic Sprinklers, GFS-650, Jun. 2019, pp. 1-29.
(Continued)

*Primary Examiner* — Jason J Boeckmann
(74) *Attorney, Agent, or Firm* — Endurance Law Group PLC

(57) ABSTRACT

A fire suppression system in which the water supply line is fitted with repeating arrays or groups of sprinkler heads. Each array is composed of at least two side-discharge sprinklers. The side-discharge sprinklers in each array are aimed so that their coverage areas point in opposite directions. Each side-discharge sprinkler includes a lateral heat shield. The lateral heat shield has a concave heat-concentering side that focuses radiant heat toward the sprinkler's trigger, and a convex heat-scattering side that disperses radiant heat away from the trigger. In some embodiments, the array can include one or more vertical-discharge sprinklers. The vertical-discharge sprinkler may include a heat collector to facilitate early activation of its trigger. The fire suppression system is advantageous in high-challenge applications like facilities where large quantities of combustible items are stored in close proximity, such as in warehouses and attics.

9 Claims, 28 Drawing Sheets

Related U.S. Application Data continuation-in-part of application No. 15/598,808, filed on May 18, 2017, now Pat. No. 10,493,308, which is a continuation-in-part of application No. 15/257,961, filed on Sep. 7, 2016, now Pat. No. 10,149,992, which is a continuation of application No. 14/661,302, filed on Mar. 18, 2015, now abandoned.

(60) Provisional application No. 62/215,058, filed on Sep. 7, 2015, provisional application No. 62/019,527, filed on Jul. 1, 2014, provisional application No. 61/955,253, filed on Mar. 19, 2014.

(51) Int. Cl.

| | |
|---|---|
| ***B05B 1/26*** | (2006.01) |
| ***A62C 37/12*** | (2006.01) |
| ***A62C 37/11*** | (2006.01) |
| ***A62C 35/64*** | (2006.01) |
| ***A62C 3/00*** | (2006.01) |

(52) U.S. Cl.
CPC ..... *A62C 37/11* (2013.01); *A62C 37/12* (2013.01); *B05B 1/267* (2013.01)

(58) Field of Classification Search
CPC ..... A62C 35/64; A62C 35/68; A62C 37/11; B05B 1/267
See application file for complete search history.

(56) References Cited

U.S. PATENT DOCUMENTS

| | | | | |
|---|---|---|---|---|
| 2,684,121 | A | 7/1954 | Lim | |
| 3,454,097 | A | 7/1969 | Groos | |
| 3,833,062 | A | 9/1974 | Livingston | |
| 4,091,876 | A | 5/1978 | Valdatta | |
| 4,279,309 | A | 7/1981 | Fischer et al. | |
| 4,296,816 | A | 10/1981 | Fischer | |
| 4,351,393 | A | 9/1982 | Tyree | |
| 4,624,414 | A | 11/1986 | Ferrazza | |
| 4,800,961 | A | 1/1989 | Klein | |
| 5,020,601 | A | 6/1991 | Retzloff et al. | |
| 5,097,906 | A | 3/1992 | Polan | |
| 5,669,449 | A * | 9/1997 | Polan | A62C 37/08 169/16 |
| 5,722,599 | A | 3/1998 | Fries | |
| 5,829,532 | A | 11/1998 | Meyer et al. | |
| 6,098,718 | A | 8/2000 | Sato | |
| 6,336,509 | B1 | 1/2002 | Polan et al. | |
| 6,540,261 | B1 | 4/2003 | Painter et al. | |
| 6,637,518 | B1 | 10/2003 | Hillier et al. | |
| 7,137,455 | B2 | 11/2006 | Green | |
| 7,290,618 | B2 | 11/2007 | Thomas et al. | |
| 7,611,077 | B2 | 11/2009 | Sesser et al. | |
| 7,757,967 | B1 | 7/2010 | Yang | |
| 7,841,418 | B2 | 11/2010 | Pahila et al. | |
| 8,474,545 | B2 | 7/2013 | Takeuchi | |
| 8,544,556 | B2 | 10/2013 | Sundholm et al. | |
| 8,602,118 | B2 | 12/2013 | Pigeon | |
| 9,302,132 | B2 | 4/2016 | Green et al. | |
| 9,339,675 | B2 | 5/2016 | Koiwa | |
| 9,381,386 | B2 | 7/2016 | Pigeon | |
| 9,849,321 | B2 | 12/2017 | Huotari et al. | |
| 9,868,005 | B2 | 1/2018 | Green et al. | |
| 10,149,992 | B2 | 12/2018 | Pigeon | |
| 2005/0045739 | A1 | 3/2005 | Multer | |
| 2007/0256844 | A1 | 11/2007 | Blasing et al. | |
| 2008/0202773 | A1 * | 8/2008 | Pigeon | A62C 35/68 169/38 |
| 2009/0218109 | A1 | 9/2009 | Sato | |
| 2015/0265865 | A1 | 9/2015 | Pigeon | |
| 2016/0023031 | A1 | 1/2016 | Thomas | |
| 2016/0375288 | A1 | 12/2016 | Pigeon | |
| 2017/0259095 | A1 | 9/2017 | Pigeon | |

FOREIGN PATENT DOCUMENTS

| | | | |
|---|---|---|---|
| GB | 532837 | A | 1/1941 |
| WO | 2009108944 | A2 | 9/2009 |
| WO | 2013148429 | A2 | 10/2013 |

OTHER PUBLICATIONS

Johnson Controls, TYCO Models BB, SD, HIP, and AP Specific Application Sprinklers for Protecting Attics, TFP610, Aug. 2018, pp. 1-28.

Reliable Sprinkler, Models DD56-6, DD56-27, DD80-6, DD80-27, D556, GP56, AH42, & AH56 Sprinklers: Specific Application Sprinklers for Attic Spaces, Bulletin 056 May 2019, www.reliablesprinkler.com, pp. 1-26.

Viking Group, Inc., Model V-BB Specific Application Attic Sprinkler Technical Data, Form No. F_042915, Oct. 25, 2018 Rev. 162.P65, pp. 1-15.

* cited by examiner

MULTI-HEAD ARRAY FIRE SPRINKLER SYSTEM FOR STORAGE APPLICATIONS

CROSS REFERENCE TO RELATED APPLICATIONS

This application is a Continuation of U.S. application Ser. No. 16/208,649 filed Dec. 4, 2018, which is a Continuation-in-Part of U.S. application Ser. No. 15/598,808 filed May 18, 2017, which is a Continuation-in-Part of U.S. application Ser. No. 15/257,961 filed Sep. 7, 2016, which claims priority to Provisional Patent Application No. 62/215,058 filed Sep. 7, 2015, and is a Continuation-in-Part of U.S. application Ser. No. 14/661,302 filed Mar. 18, 2015, which claims priority to Provisional Patent Application No. 62/019,527 filed Jul. 1, 2014 and to Provisional Patent Application No. 61/955,253 filed Mar. 19, 2014, the entire disclosures of which are hereby incorporated by reference and relied upon.

BACKGROUND OF THE INVENTION

Field of the Invention

The invention relates generally to methods and systems for extinguishing fires, and more particularly to sprinklers of such systems.

Description of Related Art

Fire suppression systems have been used in the United States to protect warehouses and factories for many years. In a fire suppression system, a fire sprinkler is positioned near the ceiling of a room where hot "ceiling jets" spread from a fire plume. When the temperature at an individual sprinkler reaches a pre-determined value, a thermally responsive trigger in the sprinkler activates and permits a flow of water toward a deflector. The deflector spreads the water into thin streams or "ligaments" that break up into droplets. The water droplets deliver water over a wide coverage area. The water droplets will directly combat fire burning within the coverage area and will wet any surrounding materials not yet combusting. Furthermore, the water droplets will cool the surrounding air through evaporation and displace air with inert water vapor.

Examples of some fire suppression systems and methods of installation are described in detail in my U.S. Pat. No. 8,602,118 (issued Dec. 10, 2013) and U.S. Pat. No. 8,733,461 (issued May 27, 2014), the entire disclosures of which are hereby incorporated by reference and relied upon.

Some fire protection applications are considered to be more challenging than others. For example, storage areas for goods, like warehouses and attics, are commonly considered high-challenge applications due to the likelihood of densely packed flammable objects stored in relatively unattended areas. In addition, attics may be further-complicated when that the framing structural members are made of combustible wood and/or the roof decking is wood-based, thereby effectively adding to the density of combustible items stored in close proximity.

High-challenge fire applications like these and others would benefit from a passive fire suppression system that is designed to react to fires with direct heavy supplies of liquid water with un-diminished volume and velocity. Such a system should not over-tax the hydraulic efficiency of the supply system. To account for high hydraulic drains, the common solution has been to increase supply line capacity (i.e., pipe diameter) and/or the water supply pressure. Unfortunately, both of these measures increase the overall cost of a fire suppression system, not only in material costs but also in labor of installation. Small businesses competing for new jobs may find it difficult to bid some larger projects due to the large working capital burdens that may be required. As a result, competition is stifled, and costs rise.

An issue common in many attic applications involves location of the sprinkler heads a rather large distance away from the ridge or peak of the roof. Installation specifications provided by manufacturers of most attic-specific sprinkler heads indicate a required minimum spacing below the ridge or peak of the roof so that an adequate spray distribution pattern has opportunity to develop. These spacing requirements severely limit the installation layout options and fails to take advantage of the concentration of heat that accumulates at the roof ridge in the event of fire.

There is therefore a need in the fire suppression and extinguishment field to create an improved fire sprinkler system for high-challenge applications that delivers a maximum density of water per unit area of ground, that maximizes hydraulic efficiencies, that improves discharge control of sprinkler heads, and that is cost effective so that working capital burdens are manageable.

BRIEF SUMMARY OF THE INVENTION

A fire suppression system is configured to disperse a liquid water over a storage area. The system comprises an elongated tubular supply line configured as a conduit to carry pressurized liquid water. The supply line has a longitudinal centerline and right and left sides separated by a vertical plane passing through the longitudinal centerline. A plurality of fire sprinklers are coupled directly to the supply line. Each the fire sprinkler is configured to receive an outflow of liquid water from the supply line. The plurality of fire sprinklers are arranged in substantially identical repeating arrays of three fire sprinklers. Each the array comprises right and left side-discharge fire sprinklers and a vertical discharge fire sprinkler. The right and left side-discharge fire sprinklers are arranged so that the right side-discharge fire sprinkler is disposed on the right side of the supply line to discharge liquid water generally perpendicularly away from the longitudinal centerline in a rightward direction, and the left side-discharge fire sprinkler is disposed on left side of the supply line to discharge liquid water generally perpendicularly away from the longitudinal centerline in a leftward direction. The vertical-discharge fire sprinkler is arranged to discharge liquid water generally along the vertical plane.

This present invention enables the advantageous combination of multiple orientations of fire sprinklers, thus combining the respective strengths of each to improve fire protection while at the same time saving both material and labor. Furthermore, the novel combining of multiple orientations of fire sprinklers eliminates certain weaknesses inherent in each orientation by itself. As a result, the fire suppression system and method harness the working power of working of multiple orientations of fire sprinklers to produce, in effect, a super fire sprinkler system and method. The fire suppression system is advantageous in high-challenge applications like facilities where large quantities of combustible items are stored in close proximity, such as in warehouses and attics. In high-challenge applications that are further complicated by combustible framing members and/or combustible roof decking, as in pitched-roof attics, the right and left side-discharge fire sprinklers can if desired be positioned in close proximity to the peak so as to discharge liquid water with a beneficial hose stream effect that wets the combustible structural members with a high-velocity water stream that helps prevent the fire from growing. This high-velocity wetting effect can, if desired, be designed to use a pitched roof or other nearby structures as a secondary deflector to enable highly-customized water distribution options.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
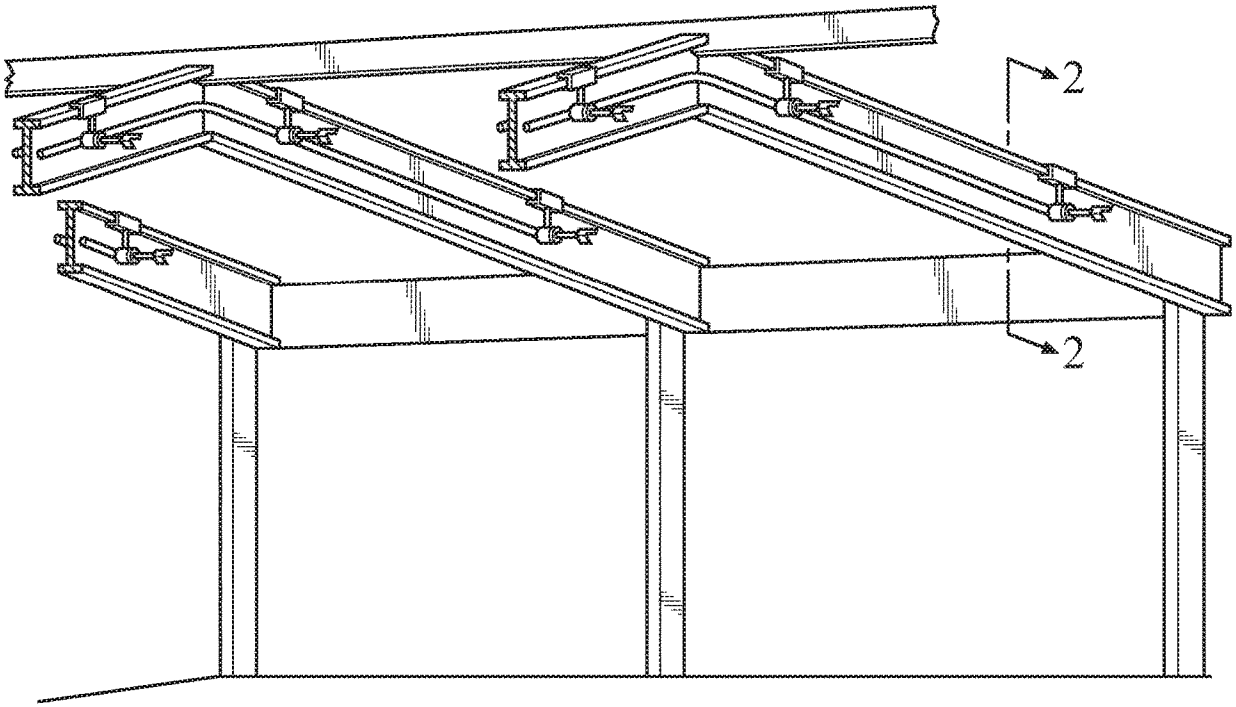
FIG. 1 PRIOR ART
FIG. 1 is a simplified perspective view of a building interior in which are installed prior are side-discharge sprinklers along opposing faces of structural beams.
Figure 3:
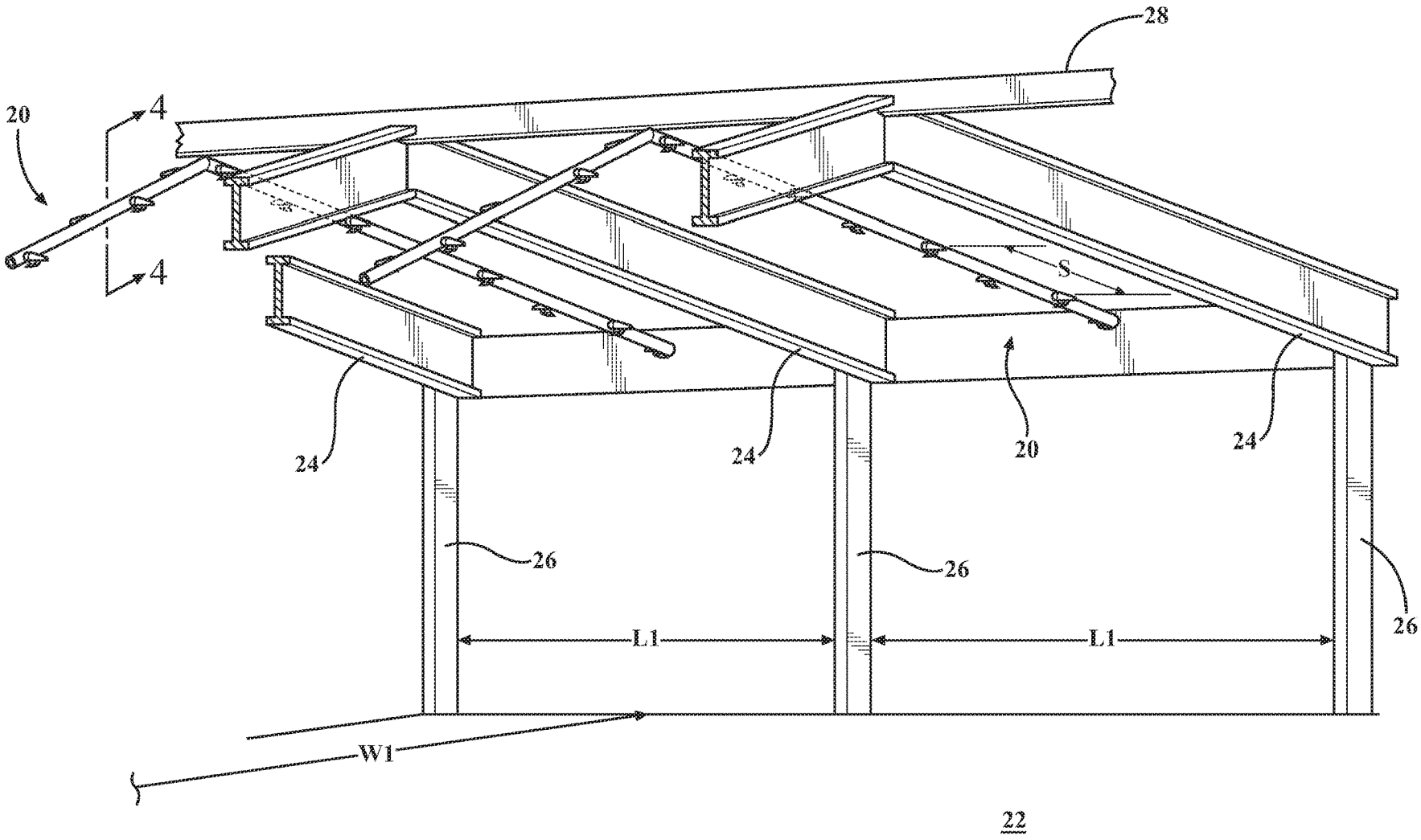
FIG. 3 is a perspective view of a building interior as in FIG. 1 but fitted a fire suppression system according to one embodiment of the present invention.

Referring to the figures, wherein like numerals indicate like or corresponding parts throughout the several views, a fire suppression system according to one exemplary expression of the present invention is generally shown at 20 in FIGS. 3-9. In FIG. 3, the fire suppression system 20 is shown located in the interior storage space of a building structure. The building structure may be a warehouse or attic or other form of storage space having a floor 22, and at least three beams 24 suspended over the floor 22. The beams 24 can be steel I-shaped beams, trusses, rafters or any suitable structural member made from any suitable material and shaped in any suitable manner. For example, in FIG. 13B the beams 24 are depicted in the form of trusses or rafters. The beams 24 are typically arranged parallel to one another and spaced evenly apart by an interior bay length L1. In the example of FIG. 3, the three beams 24 may be consider first, second and third beams 24, with the second beam being disposed in between the first and third beams 24. Beams 24 are typically supported by vertical uprights, which can be posts or walls or other suitable structure. FIG. 3 depicts the vertical uprights in the form of posts 26 spaced apart from one another by an interior bay width W1. In some constructions, purlins (not shown) may be placed perpendicularly across the beams 24 to support a ceiling or roof 27. In the example of FIG. 3, the ceiling or roof 27 is oriented at a skewed or pitched angle relative to the floor 22, however flat roof constructions are also certainly possible as suggested by FIG. 6. To be clear, the construction of the roof 27 is not critical; the principles of this invention will apply to pitched, sloped, flat, hip and possibly any other type of roof structure. In the case of sloped and pitched roofs 27, the beams 24 are usually oriented to run perpendicular to the high-point of the roof 27 which, in FIG. 3, is illustrated in the form of a ridge 28. That is to say, the pitch of the roof 27 typically runs parallel to the beams 24 and parallel to the W1 dimension. In steel frame structures like those depicted in FIGS. 1 and 3, the regions between adjacent beams 24 and spanning their full width are referred to as bays. Each bay is therefore defined by the above-noted length and width variables L1 and W1. Commonly, the bay width W1 is at least 20 feet (6 m) and the bay length L1 is at least 20 feet (6 m), although often one or both of these measures are greater. The pitch of the roof 27 slopes along the bay width W1. In the case of residential attics and other types of structures where the beams 24 take the form of rafters or trusses, the bay length L1 may be considerably shorter.

The fire suppression system 20 includes at least one supply lines 30, and in some cases a plurality of supply lines 30. Each supply line 30 comprises a fluid-conducting conduit or pipe suspended below the roof 27 of the structure, such as from its purlins (not shown) or by other suitable accommodation. The one or more elongated tubular supply lines 30 within a building structure are fed with pressurized liquid water, such as water or other suitable material, from a source under pressure, typically in the range of about 30-200 psi. The supply lines 30 may be located in the middle space between two structural beams 24 (or girders, trusses, rafters, etc.) in the building structure. That is, the supply lines 30 are advantageously located generally along the centerline of each bay area, with one supply line 30 per bay, however these are not requirements and other configurations are certainly possible. Therefore, in applications with multiple supply lines 30, the supply lines 30 are arranged generally parallel to one another under the roof 27 so that they all extend perpendicular (or at least not parallel) to the ridge 28 or other high point feature of the roof 27 in the case of sloped/pitched roofs. Many alternate arrangements are also possible, including supply lines 30 are arranged generally parallel to the ridge 28 or high point, or skewed relative to the high point, or in the case of flat roofs have some other strategic orientation.

Figure 4:
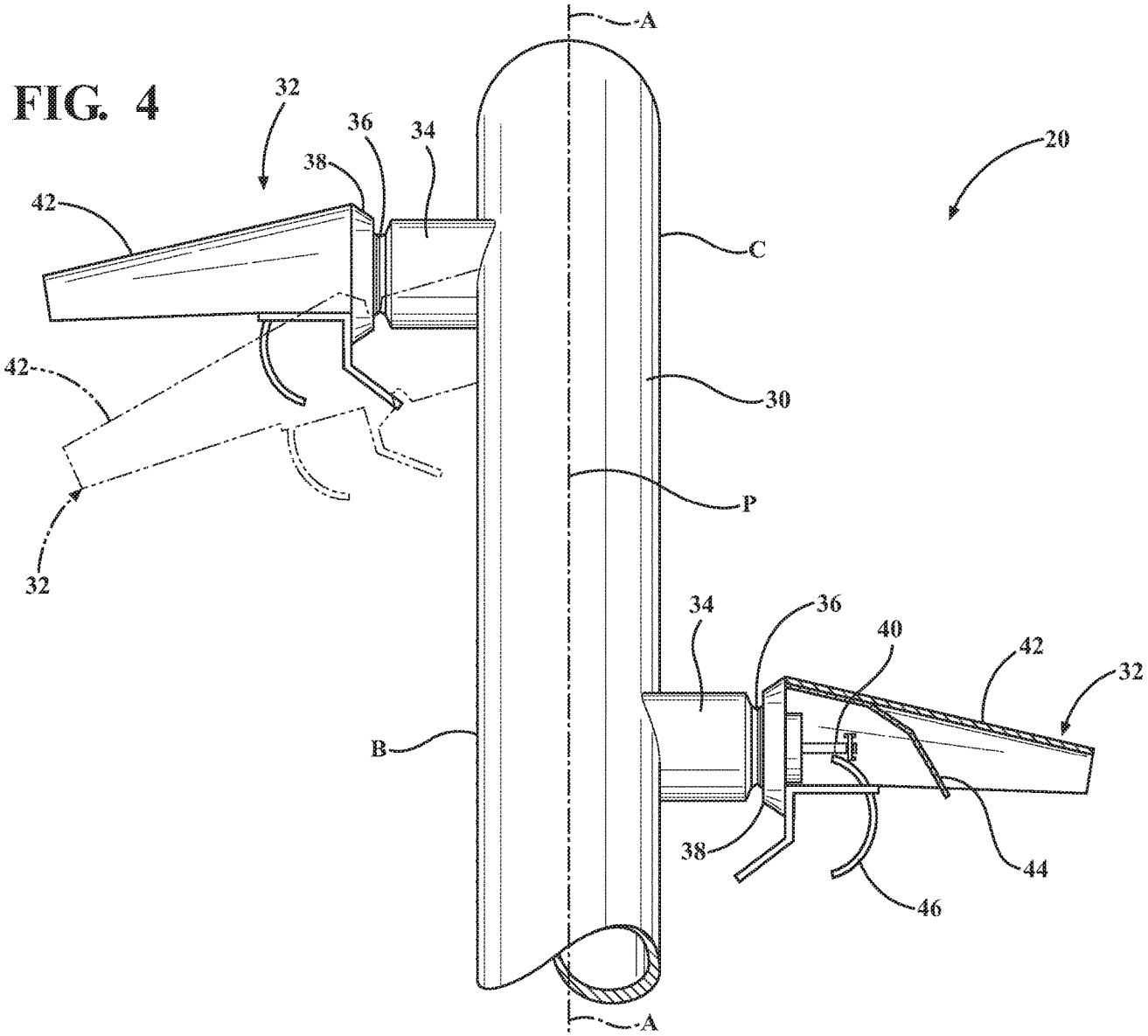
FIG. 4 cross-sectional view as taken generally along lines 4-4 of FIG. 3 showing of a section of supply line supporting two side-discharge fire sprinklers arranged in opposite-facing directions and where the deflector of one fire sprinkler is in partial cross-section.
Figure 5:
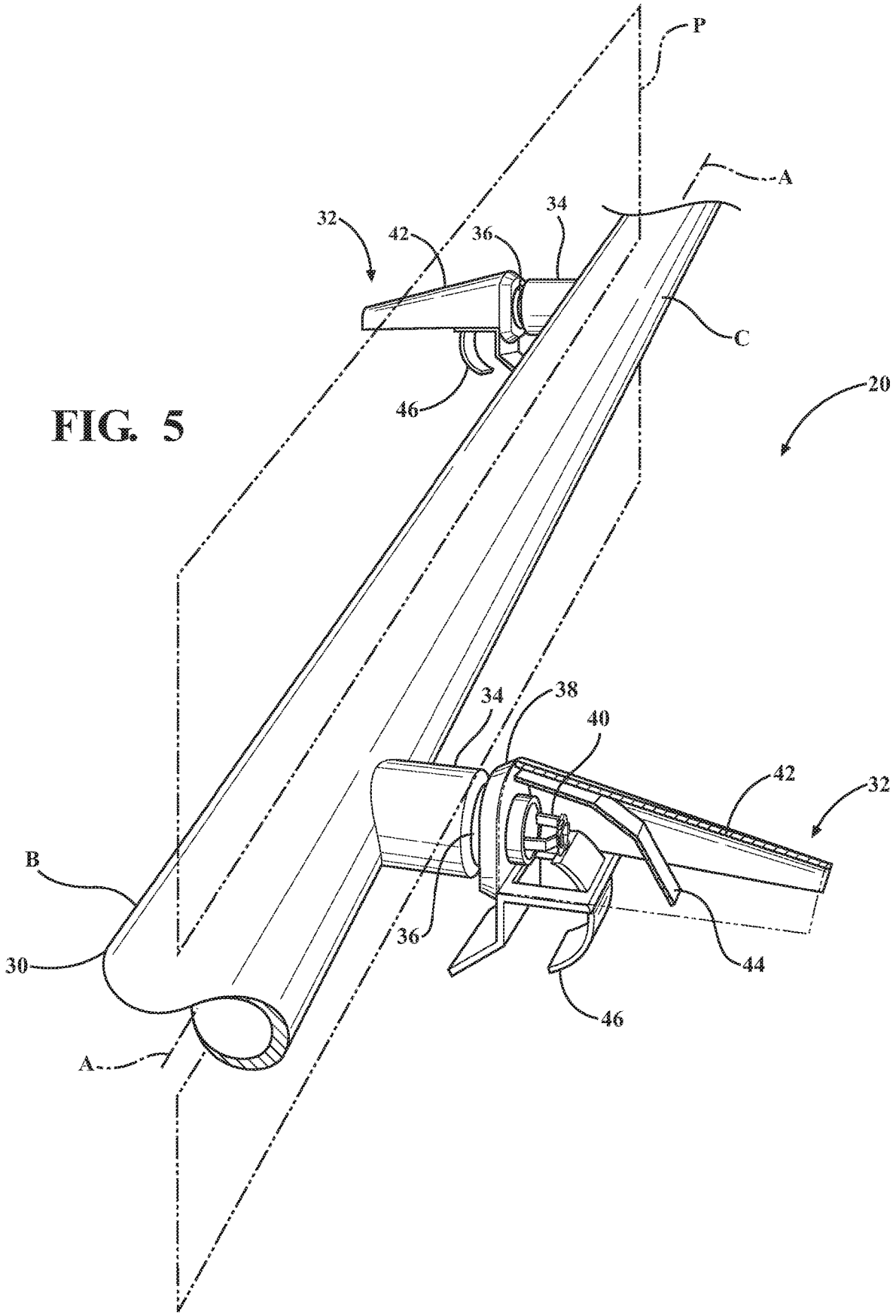
FIG. 5 is a perspective view of the section of supply line shown in FIG. 4 again with the deflector of one fire sprinkler depicted in partial cross-section.

Each supply line 30 has a longitudinal centerline A with right C and left B sides separated by an imaginary vertical plane P that passes through the longitudinal centerline A, as shown in FIGS. 4 and 5. In situations where multiple supply lines 30 are used, one supply line 30 may be deemed a first supply line 30 and the next adjacent supply line a second supply line 30. The second supply line 30 is typically disposed parallel to the first supply line 30 and is perpendicularly spaced to either the left B or the right C therefrom. The first and second supply lines 30 may be generally identical to one another such that which is the first and which is the second is of little consequence. Because the first and second supply lines are next to one another, the right-side C of one will face the left side B of another.

Side-discharge style fire sprinklers 32, sometimes referred to herein as a sprinkler head or merely a head, are part of an installed active fire suppression system disposed in a warehouse, attic, shed or other high-challenge type of storage space needing an elevated level of fire protection capability. The fire sprinklers 32 are disposed in series along each supply line 30 at regular intervals. In some applications, the interval spacing may be about two-to-ten feet depending on design criteria. In the accompanying illustrations, each fire sprinkler 32 is shown a relatively short distance, e.g., two-feet, from the next adjacent sprinkler head 32 on the same supply line 30, although the adjacent sprinkler heads 32 are aimed in opposite directions. Greater or lesser spacing are of course possible depending on the application. In the examples of FIGS. 3-10, each fire sprinkler 32 is of the side discharge type; none are vertical types. That is, the sprinkler heads 32 in these embodiments are designed to be attached to the supply line 30 so that they extend outwardly in a horizontal or generally horizontal (i.e., non-vertical) direction. Typical prior art side discharge sprinkler heads disperse water over a generally semi-circular area. While standard prior art side discharge sprinkler heads are suitable for use with the present invention, in the preferred embodiment the sprinkler heads 32 are specially configured to disperse water over a long, narrow, well-defined, coverage area 64 which many be elliptical, oval or rectangular.

The plurality of fire sprinklers 32 are arranged along a common supply line 30 so that half of the fire sprinklers are disposed on the right-side C of the supply line 30 and the other half of the fire sprinklers 32 are disposed on left side B of the supply line 30. At the location where each fire sprinkler 32 is intended to adjoin the supply line 30, a saddle 34 is fitted in place. Each saddle 34 perpendicularly intersects the supply line 30. The saddle 34 is provided with a central aperture (not visible) that fluidly connects with the internal conduit region of the supply line 30 so that an outflow of liquid water can travel from the supply line 30 into the central aperture when the sprinkler head 32 is activated. The surrounding body of the central aperture has a threaded interior surface that is designed to mate with external threads of the sprinkler 32. During fabrication of a fire suppression system, an installer will typically drill holes in the supply line 30 at the locations where fire sprinklers 32 are desired. Half of the holes will be drilling on the left side L, and the other half on the right-side R of the supply line 30. Saddles 34 are then welded or otherwise sealed to the supply line 30 over the drilled holes. Finally, fire sprinklers 32 are screwed into respective saddles 34 prior (or subsequent) to hanging the supply line 30 from the supporting structure in the warehouse or other building structure similar to that shown in FIG. 3.

Two supply lines 30 are illustrated in FIG. 3, which for purposes of discussion may be referred to as the first and second supply lines 30. The spacing between the first supply line 30 and the second supply line 30 is approximately equal to the bay length L1 of either bay. Because of the wide spacing between adjacent first and second supply lines 30 enabled by this invention, as will be described below in connection with FIGS. 8 and 9, the installer is afforded substantially greater freedom to locate supply lines 30 far from the beams 24 which might otherwise present an obstruction to the spray pattern. FIG. 3 represents a scenario where the supply lines 30 are set so that only one supply line 30 is between each adjacent pair of beams 24. This represents a substantial reduction in the number of supply lines 30 to be installed as compared with prior art systems, and therefore a significant reduction in system/installation costs and long-term maintenance expenses, as well as an improvement in fire suppression performance.

The fire suppression system 20 shown in FIGS. 3-9 depicts use of a special application listed side-discharge-type sprinkler. The side-discharge sprinkler 32 includes a threaded nipple 36 that is configured with external thread forms to be screwed into a threaded female saddle 34. A frame 38 is supported from the nipple 36. The frame 38, in turn, supports a trigger 40 and a deflector. The deflector can be any device that shapes the dispersion of water, including nozzle-like elements as well as more traditional deflecting and diffusing features. In the illustrated examples, the deflector includes an elongated, nozzle-like hood 42 having a downward slant to efficiently direct water flow so as to achieve a desired coverage area with minimal splash or turbulence. The thermally responsive trigger 40 is at least partially shrouded by the hood 42. That is to say, the hood 42 provides shelter for the trigger 40. The deflector also includes an optional baffle 44. The baffle 44 in these examples is a thin, strip-like element that is supported below the hood 42. The baffle 44 is somewhat cantilevered and arranged to extend outwardly with the hood 42, i.e., perpendicular to the supply line 30. The width of the baffle 44 is considerably less than the interior width of the hood 42 so that a substantial quantity of discharged water will flow unaffected around the sides of the baffle 44. In use, the baffle 44 provides at least two beneficial functions. Prior to activation of a fire sprinkler 32, the baffle 44 provides a measure of passive protection to the thermally responsive element 40 from the spray of an adjacent sprinkler 32 so as to reduce the possibility of cold soldering. In cases where an adjacent sprinkler 32 is earlier activated, the incoming fluid spray will be at least partially deflected by the baffle 44. After activation of a fire sprinkler 32, the baffle 44 assists like a dynamic flow control vane to help evenly distribute liquid water within the coverage area. The deflector is also shown including a downwash section 46 which, like the baffle 44, also acts as a splash shield and helps evenly distribute liquid water within the coverage area below the supply line 30. Naturally, the deflector shown in the accompanying Figures may be highly modified with additional flow controlling features in order to achieve a well-defined coverage area 64 with water density distribution characteristics as may be desired.

A duct extends through the nipple 36 to create an internal flow path for water or other fire suppressing substance from the supply line 30 along an outflow axis. The outflow axis is generally perpendicular to the longitudinal extent of the supply line 30, and in one preferred embodiment is generally horizontal. That is to say, the outflow axis may be generally parallel to the floor 22, however as suggested in phantom in FIG. 4 the outflow axis may be skewed from horizontal in certain applications as a means to achieve the desired spray coverage area 64. A plug-like closure element that is mated with the trigger 40 blocks the duct until activated by an elevated internal building temperature. Once the trigger 40 is tripped, the closure is ejected and water (or other substance in the supply line 30) rushes out under pressure through the duct along the outflow axis and collides with the deflector to spray over a non-circular individual coverage area 64. The trigger 40 is a thermally responsive element that responds to heat from a fire plume and then releases the closure, thereby permitting the flow of the fire suppressing or extinguishing substance. The thermally responsive element may be a fusible link assembly comprised of two link halves which are joined by a thin layer of solder. When the rated temperature is reached, the solder melts and the two link halves separate, allowing the sprinkler 32 to activate and water to flow. Alternatively, the trigger 40 may be of the glass bulb type which is designed to shatter when the rated temperature is reached, or any other suitable device or method. The trigger 40 may include any suitable method or device to block the flow of the fire suppressing or extinguishing substance through the duct until activated.

As stated above, on any given supply line 30, half of the sprinklers 32 are placed on the right-side C and the other half on the left side B. The plurality of fire sprinklers 32 are arranged in alternating fashion on the right C and left B sides of the supply line 30 such that every other fire sprinkler 32 is disposed on the right-side C of the supply line 30 with the other fire sprinklers 32 disposed on the left side B of the supply line 30. Thus, every other side-discharge-type sprinkler 32 is set in an opposite-facing direction along the same supply line 30. In this arrangement, any two adjacent sprinklers 32 may be considered a pair with one of the sprinklers 32 pointing left and the other fire sprinkler 32 pointing right. The pair of fire sprinklers 32 may be identical to one another or distinct. The drawings describe the embodiment where the sprinklers 32 on the left side B are longitudinally offset from the sprinklers 32 on the right-side C. However, in another contemplated application the sprinklers 32 are located in direct back-to-back relationship.

In order to put this opposite-facing arrangement into effect, the saddles 20 of the respective sprinklers 32 are fixed on horizontally opposite sides of the same supply line 30, so that their respective outflow axes each perpendicularly intersect the supply line 30. As shown by the phantom lines in FIG. 4, it is contemplated that one saddle 34 (or both) may be placed so that the sprinkler 32 extends at a skewed angle relative to horizontal as an alternative to bending or otherwise adjusting the position of the hood 42. Indeed, some applications may lend themselves to orienting the two opposite-facing sprinkler heads 32 at different angles relative to horizontal. As an example, the right-side sprinkler head 32 may be angled 5 degrees below horizontal, and the left side sprinkler 32 angled 10 degrees below horizontal in order to aim the sprayed water relative to the overall height and location of any stored items.

Figure 2:
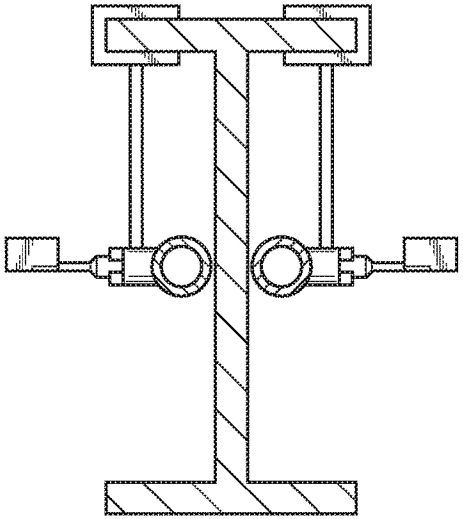
FIG. 2 PRIOR ART
FIG. 2 is a cross-sectional view taken generally along lines 2-2 of FIG. 1.

In order to address the potential of cold soldering due to two sprinkler heads 32 being located so close to one another, it may in some applications be desirable to place at least one blocking surface in-between the two fire sprinklers 32. The blocking surface may be configured as a component of the fire suppression system 20 that is supported by the supply line 30 or by a component (e.g., a sprinkler head 32) which in turn is supported by the supply line 30, rather than comprising a feature of the building structure like that shown in FIGS. 1 and 2. The blocking surface could be configured to block liquid water that is discharged from one of the fire sprinklers 32 from contacting the other fire sprinkler 32 so that the trigger 40 of the second fire sprinkler 32 is not delayed from activating in a timely fashion. A blocking surface may take many different forms to facilitate the close-spacing of side-discharge sprinklers 32 so that spray from one sprinkler 32 does not over-cool an adjacent un-activated sprinkler 32 and thereby delay its activation. The blocking surfaces should be designed so that all of the side-discharge sprinklers 32 operate essentially independent of one another and fully according to their design specifications.

In the illustrated embodiments, the shape of the deflector in which the trigger 40 is substantially shrouded and enclosed forms a type of blocking surface. Indeed, the trigger 40 is only exposed from the discharge end of the deflector and from below, where a gap in the downwash member 46 is provided. This distinctive configuration allows heat rising from a fire to directly enter the deflector and be channeled toward the trigger 40. The deflector in fact collects and concentrates the heat onto the trigger 40 thereby encouraging early activation. However, the trigger 40 is otherwise shrouded from water spray caused any other nearby sprinklers 32. As a result, the possibility of cold soldering is substantially reduced or eliminated.

In this manner, the deflector creates a cave-like shell around the sides and top of the trigger 40; only the discharge direction and the bottom of the cave-like enclosure are open. Accordingly, the blocking surface fulfills several functions simultaneously to enable effective use of side-discharge-type sprinklers arranged on opposite-facing sides of the same supply-line 30 in a warehouse application. These include acting as a splash guard to prevent water that sprays sideways or rearwardly (e.g., in response to contact with an obstruction) from reaching the trigger 40 of a nearby sprinkler 32, reflecting heat onto the unactuated trigger 40 of the sprinkler 32 so that the trigger 40 will activate in a timely fashion if/when needed, and shaping the water flow to achieve a desired coverage area 64 and water density distribution.

In another contemplated variation (not shown), a standard prior art side-discharge sprinkler head is used and a blocking surface in the form of a backer plate can be associated with each sprinkler head. The backer plate could be a formed sheet-metal member and arranged to overhang the sprinkler like a small roof. Such a backer plate could be integrated with the deflector and/or the frame of a sprinkler head. In any event, the backer plate should be effective to negate the condition known as cold-soldering that could otherwise arise in the event a first sprinkler is set-off prior to the second sprinkler.

Figure 6:
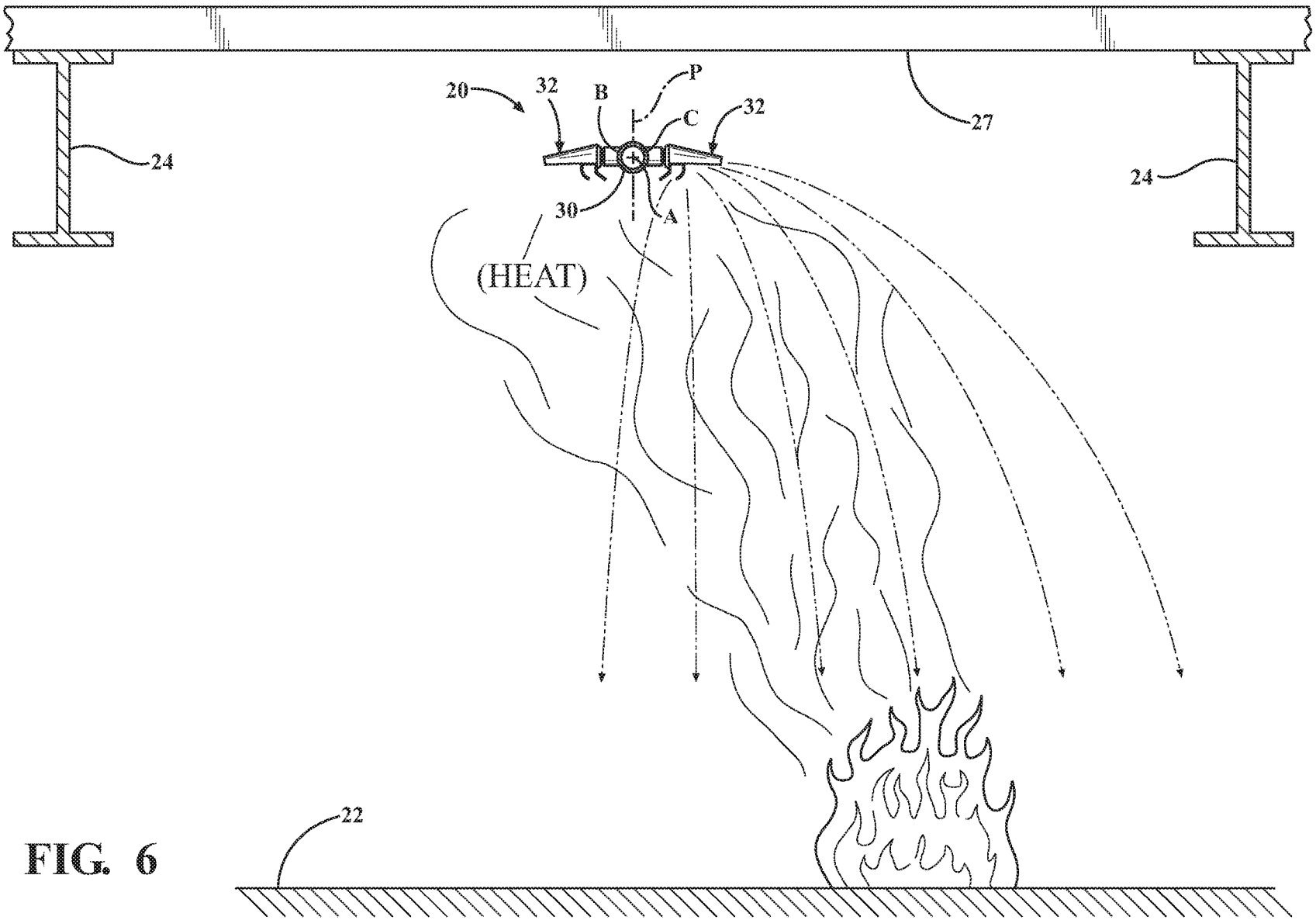
FIG. 6 is a simplified view of the present fire suppression system in which one side has been activated to suppress a fire below.

FIG. 6 shows two side-discharge sprinklers 32 arranged opposite-facing directions above a bay area between two adjacent beams 24 and covered by a roof 27. In this illustration, a fire has broken out on the right side of the bay area below the fire suppression system 20, setting off the right side-discharge sprinkler 32 but not the left side-discharge sprinkler 32. As water (or other liquid substance) sprays from the right side-discharge sprinkler 32, the blocking surface associated with the right side-discharge sprinkler 32 deflects the water spray so that it cannot contact the left side-discharge sprinkler 32. Meanwhile, the left side-discharge sprinkler 32 is poised to activate in a timely fashion if/when needed. This ready condition of the left side-discharge sprinkler 32 is passively facilitated by its associated blocking surface. In particular, the blocking surface of the left side-discharge sprinkler 32 acts as a shield that prevents collateral overspray and water splashes from contacting its unactuated trigger 40 (i.e., to prevent cold-soldering). Furthermore, the blocking surface of the left side-discharge sprinkler 32 reflects and funnels heat from the fire toward its trigger 40 so that its activation timing is not adversely affected (i.e., delayed) by the ambient water spray from the right side-discharge sprinkler 32.

Figure 7:
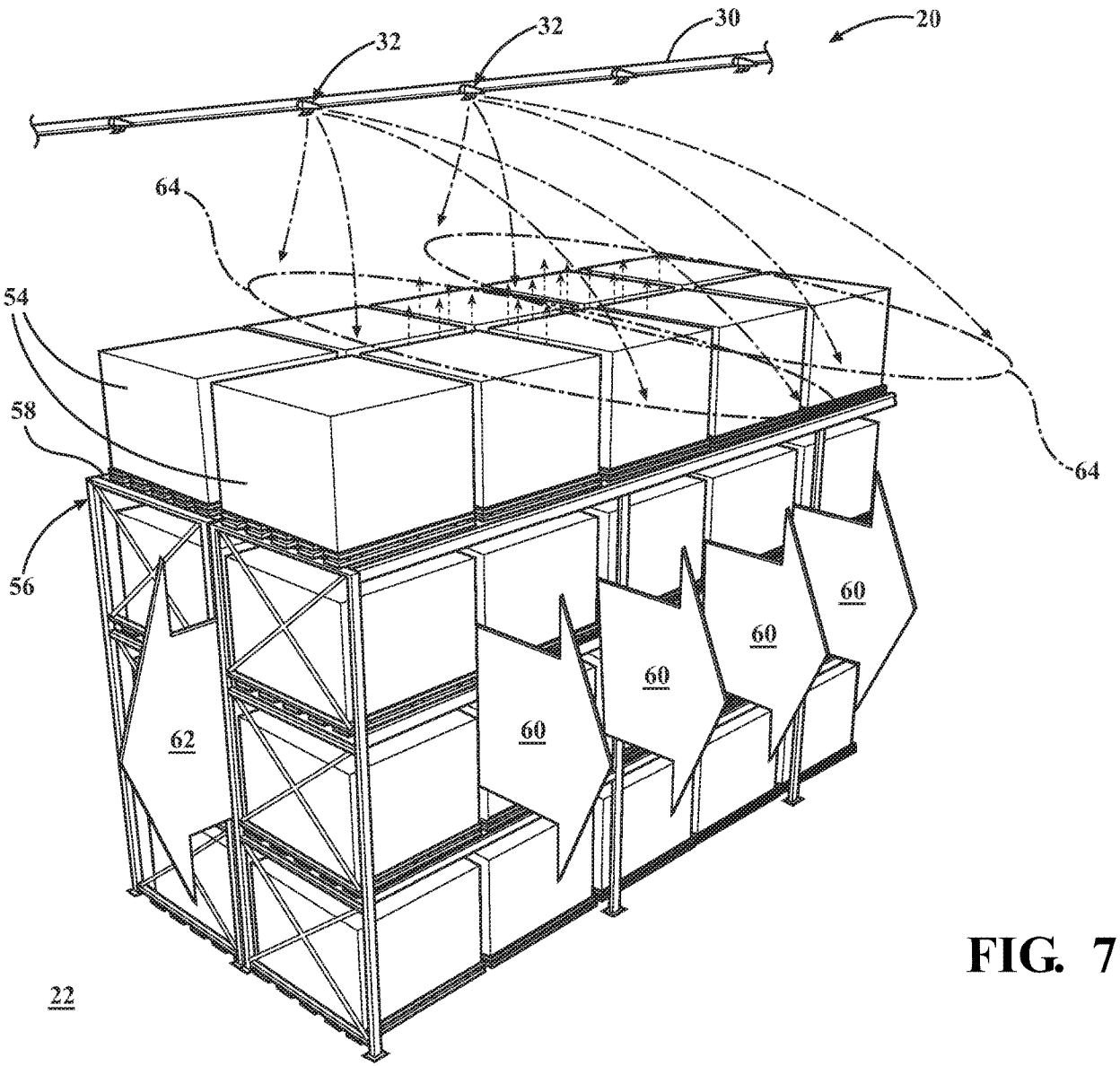
FIG. 7 is a perspective view showing the sprinkler system of one embodiment installed above stored items and with two fire sprinkler heads activated in response to heat rising from the flues in-between the stored items.

In FIG. 7, stored items 54 are shown disposed on the floor 22 in the warehouse. In a warehouse, stored items 54 are frequently stacked or arranged in long rows. Also commonly, the stored items 54 may be stacked in elongated storage racks, generally indicated at 56, which in turn are disposed on the floor 22 in the warehouse. In FIG. 7, one such storage rack 56 is shown. Commonly, a warehouse facility will arrange many storage racks 56 in opposite-facing pairs separated by aisles large enough for a forklift to maneuver. The common storage rack 56 has a plurality of shelves 58 upon which are placed the stored items 54. Oftentimes, the stored items 54 are palletized, or otherwise carried on standard 4×4 pallets to facilitate handling with a forklift (no shown). Of particular note is the overall height of the stored items 54 either standing free or when arranged in rows. When stored items 54 are stacked in shelves 58 of the storage racks 56, the lofty stored items 54 on the uppermost shelf 56 will define the overall height, which is the highest level or region of goods that must be protected by the fire suppression system 20.

Within this context, the fire suppression system 20 is suspended from above in the warehouse, at an elevation that is greater than the overall height of the stored items 54 disposed below. In the event of a fire, wherein it is presumed that the locus of the fire is in or at a storage item 54 somewhere in a storage rack 56. The arrangement of storage racks 56 and the typical placement of palletized stored items 54 on the various levels of shelves 58 in the storage racks 56 establish a plurality of transverse flues 60 and one longitudinal flue 62. These flues 60, 62 are indicated by wide directional arrows. Naturally, such flues 60, 62 can exist in solid-pile (non-racked) type storage arrangements. The transverse flues 60 are formed in the gaps between adjacent stored items 54. The longitudinal flue 62 is created in the gap between two storage racks 56 when arranged back-to-back. The importance of these flues 60, 62 becomes relevant when a fire is present in or adjacent one of the stored items 54. Perhaps a worst-case scenario in terms of fire suppression is when a fire originates between two storage racks 56 arranged back-to-back (i.e., in the longitudinal flue 62 area) at or near the floor 22, which is suggested by heat arrows rising from the flues 60, 62 in FIG. 7. This is the most distant and difficult to reach region for liquid water dispersed from a fire sprinkler 32.

The fire produces hot combustion gases that travel upwardly through the narrow flues 60, 62 like chimneys. When the escaping heat is sufficient to activate at least one nearby overhead fire sprinkler 32, water (or other liquid fire suppressing agent) will be discharged. In order to be effective, the water must travel down the very same flues 60, 62 through which heat from the fire is rising up. The rising heat, concentrated within the narrow passageways of the flues 60, 62, will tend to vaporize the descending water spray unless sufficient quantities of water and/or large enough droplet sizes can be applied to overpower the heat. The greatest success at fire suppression will be achieved when, at the initial stages of a fire, a maximum amount of water is applied in a tightly-focused stream at high velocity to the flues 60, 62 directly above the fire locus.

The present fire suppression system 20 is configured and arranged so that, at all stages of a fire but particularly at the initial stages, a maximum amount of water is applied in a jet stream, i.e., with relatively high velocity and narrow spread, to the flues 60, 62 laying directly above the fire so that very little spray is wasted dousing nearby (non-burning) stored items 54. Furthermore, the fire suppression system 20 is capable of generating a water curtain effect that resists spread of the fire to adjacent storage racks 56. In the event of fire in a storage rack 56, the activated fire sprinklers 32 will create a beneficial water curtain in the adjacent aisles and/or flues 60, 62 to discourage fire spread, thereby helping to contain the fire in the smallest possible region. This invention is uniquely designed to combat fires in high-challenge storage settings, including warehouses and attics, where items 54 are tightly stacked or arranged and water from activated fire sprinklers 32 must travel into narrow flues 60, 62 to reach a fire.

Figure 8:
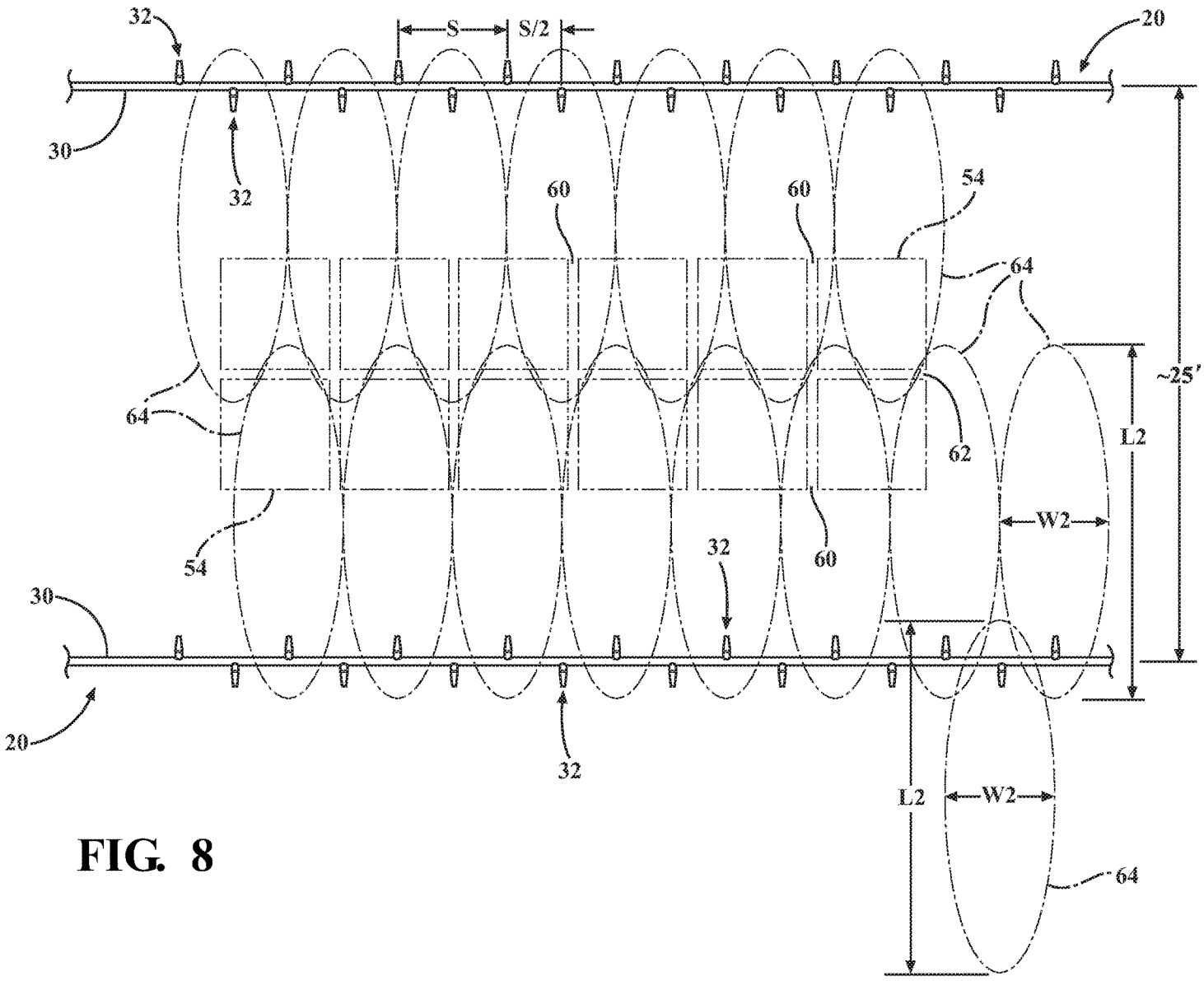
FIG. 8 is a top view showing two parallel supply lines arranged over a row of stored items, each supply line being fitted with opposite-facing sprinkler heads according to one embodiment of the present invention, and further illustrating exemplary spray discharge patterns from several of the sprinkler heads to illustrate an exemplary coverage strategy.

FIG. 8 is a simplified top view of a fire suppression system 20 according to one embodiment of this invention where two adjacent supply lines 30 (i.e., first and second) are disposed in a building structure, perhaps arranged along the centerlines of two adjacent bay areas between three adjacent beams 24 like that shown in FIG. 3. As an example, the spacing between the two adjacent supply lines 30 may be about twenty-five feet. Of course, an installer or a qualified spec writer may decide that the spacing between the two adjacent supply lines 30 should be larger or smaller. Each sprinkler head 32 is schematically illustrated and arranged in the alternating fashion with blocking surfaces protecting its trigger 40. Furthermore, if one were to rotate FIG. 8 ninety degrees in a counter-clockwise direction, the left-hand supply line 30 could be considered the "first" and the right-hand supply line 30 the "second." It is then evident that the fire sprinklers 32 on the right-side C of the first supply line 30 face toward the second supply line 30. And similarly, the fire sprinklers 32 on the left side B of the second supply line 30 face toward the first supply line 30. In other words, the fire sprinklers 32 on the left side B of the second supply line 30 point toward the fire sprinklers 32 on the right-side C of the first supply line 30 somewhat like the cannons of two ancient battleships.

As stated previously, each fire sprinkler 32 is configured to disperse an outflow of liquid water like a fire hose over a non-circular individual coverage area 64. The coverage areas 64 are represented by broken lines in FIGS. 7-9, as may be understood as the point of contact with the uppermost surfaces of stored items 54 located on the highest elevation shelves 58 in the storage racks 56. Standard prior art side-discharge sprinkler heads, which are usually intended for wall-mounted applications, typically disperse water over a generally semi-circular area. While standard prior art side discharge sprinkler heads are suitable for use with the present invention, in the preferred embodiment the deflectors are configured so that the coverage areas 64 are more elongated in shape. The non-circular individual coverage areas 64 from any paired fire sprinklers 32 are contiguous and generally mirrored. If any paired fire sprinklers 32 are placed directly back-to-back along the supply line 30, then their combined coverage areas 64 would merge and define a generally elliptical or oval or rectangular area. However, in the illustrated examples paired fire sprinklers 32 are longitudinally offset along the supply line 30 so that their respective coverage areas 64 are likewise offset, as well as focused in opposite directions, as shown in the lower right-hand corner of FIG. 8.

Figure 9:
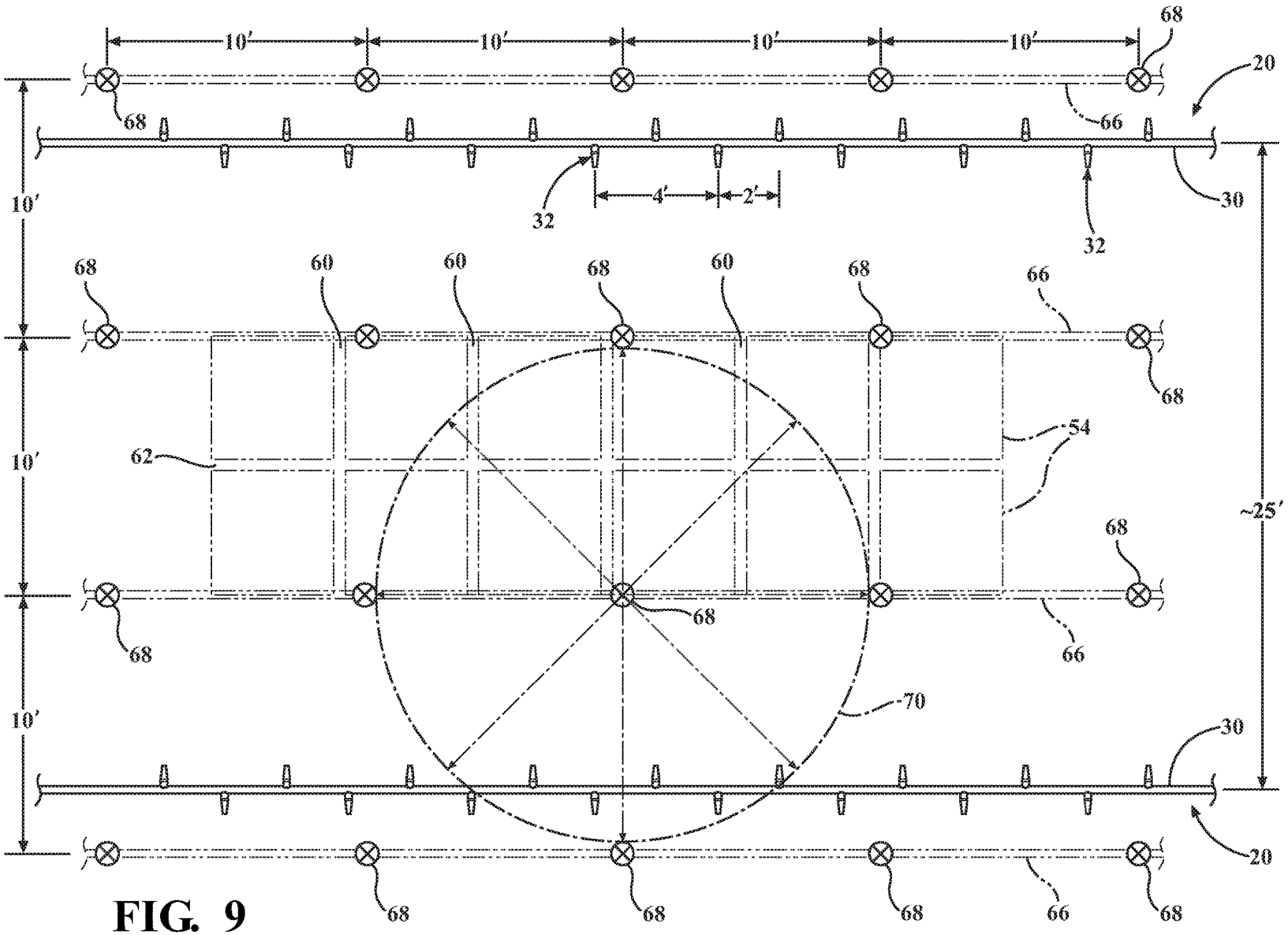
FIG. 9 is a view as in FIG. 8 but further superimposing a prior art fire suppression system comprising four supply lines with omni-directional heads arranged in the common 10'×10' grid pattern for comparison purposes.

The coverage area 64 from each sprinkler head 32 has a major diameter L2 which is generally perpendicular to the supply line 30 and a shorter minor diameter W2 that is generally parallel to the supply line 30. While the terms "major diameter" and "minor diameter" are suggestive of elliptical geometries, and indeed several of the Figures depict elliptical shapes, coverage areas could have oval or rectangular geometries, or other suitable shape as may be deemed acceptable. The minor diameter W2 may be between about 5% and 100% of the major diameter L2, and in some preferred embodiments W2 is between about 15% and 67% of L2. More specifically, W2 may be less than 50% of L2 in order to produce a discharge jet that more closely mimics the powerful stream from a fire hose. The major diameter L2 may be smaller than the perpendicular spacing between the first and second supply lines 30, and also slightly larger than half the distance between adjacent supply lines 30 to account for some degree of overlap. So, in the example of FIG. 8 where the distance between adjacent supply lines 30 is shown as about twenty-five feet, the L2 may be somewhat greater than twelve-and-a-half feet—perhaps about fourteen feet. Every other sprinkler head 32 located along the same supply line 30 is spaced apart by a spacing distance S. That is to say, when considering only the sprinkler heads 32 on one side (left B or right C) of the supply line 30, the separation intervals are the spacing distance S, as shown in FIGS. 3 and 8. The minor diameter W2 of the combined coverage area is slightly larger than the spacing distance S to account for some degree of overlap. In one embodiment of the invention, the spacing distance S is between about two feet and ten feet. In the example of FIG. 9, the spacing distance S is four feet. In the example where the spacing distance S is four feet, W2 may be somewhat greater than four feet—perhaps about five to six feet which is less than 50% of L2.

The sprinklers 32 of this invention may be installed in an optional stagger spaced arrangement both along the respective supply lines 30 and within the structure. The stagger spaced arrangement is designed to redirect the sprays of water into the structure with strategically interwoven coverage areas. According to this arrangement, for each adjacent pair of first and second supply lines 30 extending parallel to one another, opposing sprinkler heads 32 are set in an offset relationship relative to one another. That is, the inwardly facing sprinklers 32 along one supply line 30 are not pointing directly at, i.e., not in line with, the inwardly facing sprinklers 32 of the other supply line 30. Said another way, the coverage area 64 from a sprinkler 32 on one supply line 30 is longitudinally (i.e., along the length of a supply line 30) offset from the coverage area 64 of an opposing sprinkler 32 on the next adjacent supply line 30. Thus, a person standing on the floor 22 in the building and looking up toward the roof 27 will observe that as between two adjacent supply lines 30 the rightward-pointing sprinklers 32 on the first supply line 30 do not line up in the L1/L2 directions with the leftward-pointing sprinklers 32 on the second supply line 30; the heads 32 are in fact staggered in an alternating fashion. The off-set may be equal to approximately one-half of the spacing distance S, or "S/2" as shown in FIG. 8. In the example of FIG. 9, where the spacing distance S is four feet, the longitudinal offset is about two feet.

FIG. 8 shows this stagger spacing arrangement, where the combined elliptical coverage areas 64 are similar in some respects to those described in my U.S. Pat. No. 9,381,386 issued Jul. 5, 2016, the entire disclosure of which is hereby incorporated by reference. However, in this embodiment the inwardly pointing coverage areas 64 between each adjacent pair of supply lines 30 are offset to one another. Furthermore, according to the illustrated example, along one supply line 30 each paired set of sprinklers 32 are longitudinally offset from one another by the same half spacing S/2 in a regular alternating pattern. In this manner, a design spacing distance S is calculated or otherwise predetermined to disperse water over the underlying combined coverage areas 64. The sprinklers 32 on right side C of the first supply line 30 are arranged in-between the opposing sprinklers 32 on the second adjacent supply line 30 (i.e., on the left side B) side so that the inflows of coverage areas 64 applied between these two supply lines 30 are spaced equally with the half spacing distance (S/2). In this manner, the coverage areas 64 are interleaved with one another, and depending on the W2 and L2 dimensions may even overlap one another. In the example of FIG. 8, the major diameter L2 of each combined coverage area 64 is optimally distributed into the cove or valley-like regions between the coverage areas 64 in the two opposing sprinklers 32 of the adjacent supply line. Thus, the interlaced coverage areas 64 by two opposing sprinklers 32 achieve and optimal use of water. However, given that water pressure has a direct effect on the actual size of the coverage area 64, and because water pressure will diminish as more fire sprinklers 32 are activated, it may be desirable to design a generous overlap—on the order of one to three feet—for a single-activated fire sprinkler 32. It is therefore understood that as water pressure diminishes due to additional fire sprinklers 32 being activated, the modestly shrinking coverage area 64 will remain in an ideal geometric condition with the next adjacent coverage area 64. Therefore, the degree of overlap needed between adjacent coverage areas 64 may be calculated for each installation based on line pressure, supply line 30 sizes and other relevant factors.

In the example of FIG. 8, the minor diameter W2 of each coverage area 64 is at least equal to S, and may be between about S and 2S (i.e., between one- and two-times S). In this example, the major diameter L2 of each coverage area 64 is greater than half the distance between adjacent supply lines 30 (e.g., >12.5 feet) so that at its farthest end the coverage area 64 reaches into the cove or valley-like space between the coverage areas 64 in the two opposing sprinkler sets 32 of the adjacent supply line 30. The large lateral reach in the major diameter L2 direction is benefitted when installed in a structure fitted with open web type beams 24, such that the supply lines 30 can be located very near to the ceiling with water sprays easily passing through the open webbings. It is to be understood that the illustrated examples fully contemplate extension of these teachings to buildings that have many bays, with the stagger spacing concepts being repeated between every two adjacent supply lines 30.

An advantage of the present invention can be readily appreciated by comparing FIG. 9, which overlays a typical prior art sprinkler system with the novel stagger spacing concepts depicted in FIG. 8. The prior art system is identified by supply lines 66 (drawn as broken lines) carrying traditional pendant style spray heads 68. The superimposed prior art system shown here may be of the Early Suppression Fast Response (ESFR) type in which fast response sprinklers 68 are designed to discharge a high effective water density in order to combat a fire plume, particularly in high rack storage applications. In a typical prior art ESFR system, the supply lines 66 are spaced apart ten feet and the sprinkler heads 68 are spaced apart ten feet. This places the prior art sprinkler heads 68 in a ten-by-ten foot grid pattern.

As shown in FIG. 9, a prior art ESFR system requires about four supply lines 66 to cover the same area as the present suppression system 20 having only two supply lines 30. The labor savings represented by a 50% reduction in supply line installation is significant. Furthermore, as will be validated below, the supply lines 30 of the present invention can be smaller in diameter than the prior art ESFR supply lines 66, thus representing a further cost reduction, as well as a weight reduction which translates to smaller supporting brackets and possibly smaller purlins or other structural elements from which the supply lines 30 are hung.

The prior art spray heads 68 are shown having the typical circular spray pattern 70 (only one spray pattern 70 shown for simplicity). If the prior art ESFR is presumed to be supplied with water at 52 psi, which is a common specification, and the ESFR spray heads 68 are rated at a 16.8 k-factor, a reasonable assumption, then the discharge rates from each spray head 68 can be calculated at about 121 gallons per minute using the formula:

$$q=k*p^{0.5}$$

Where: q is the flow rate;
k is the nozzle discharge coefficient; and
p is the line pressure Assuming the prior art spray heads 68 are spaced ten feet apart, each spray head 68 is responsible for about one hundred square feet of area and the applied water density onto the stored items 54 per spray head 68 will be in the order of about 1.21 gallons/square foot. In contrast, the system 20 of the present invention may be fitted, for example, with supply lines 30 that carry 35 psi water pressure and spray heads 32 having a k-factor of 14. At these specifications, water distribution from each spray head 32 will be on the order of about 83 gpm. However, if the coverage areas 64 for the sprinkler heads 32 are defined by W2 at four feet and L2 at fourteen feet, the applied water density per spray head 32 onto the stored items 54 will be in the order of about 1.48 gallons/square foot. In other words, the present invention contemplates applying more gallons per square foot through each spray head 32 than is achieved by a typical prior art ESFR type spray head 68 of a larger k-factor and using higher line pressures.

Of course, the critical objective is to arrest growth of a fire at the earliest possible moment. When the initial sprinkler head 68 of the prior art activates, only the 1.21 gallons/square foot is applied. And with spray heads 68 set the typical ten feet apart, it may take several precious moments for additional spray heads 68 to activate. In contrast, the spray heads 32 of the present invention are set at a much closer spacing S, which spacing is further reduced to S/2 (or other fraction) by the novel stagger arrangement, so that more sprinkler heads 32 will be activated more quickly with respective coverage areas being more accurately distributed toward the fire plume. As a result, more water is directed at the fire more quickly than prior art systems.

Heat from a fire plume will initially activate more adjacent sprinkler heads 32 due to the close and stagger spacing features of this invention. Because of the directional, non-circular projection 64 of water spray from activated spray heads 32, it is expected that a majority of discharged water will be directed toward the fire. As a result, water usage is reduced (compared to the prior art) and the potential for collateral water damage is similarly reduced. Importantly also, a maximum discharge of water is directed at the nascent fire, thereby increasing the likelihood that the fire will be rapidly suppressed. In comparison with the prior art, less pressure robbing water is wasted spraying away from the fire and causing collateral water damage to otherwise unaffected stored items 54. More water is thus available to apply directly into the flues 60, 62 with an increased opportunity to control the fire before it has a chance to spread.

Benefits of this present invention are many. The blocking surfaces enable the use of side-discharge type sprinklers (special application types listed for the given fire scenario) that can be supplied from any reputable manufacturer, or the unique sprinkler heads 32 described above. Increased water density can be provided compared with standard, vertically oriented sprinklers 68. Less water damage might occur in cases where only one sprinkler 32 is activated. And the cost of installation is predicted to be less than that of prior art ESFR systems.

The claim of increased water density is accomplished by the ability of this present invention to utilize side-discharge type sprinklers 32 that have the ability to more accurately distribute water toward underlying stored items 54. The claim of reduced installation cost results from the use of one common supply line 30 per bay area (as compared with two supply lines according to prior art techniques like that taught by U.S. Pat. No. 7,331,399) and also from the potential to separate supply lines 30 a relatively large distance apart (e.g., twenty-five feet) due to the long, narrow and staggered coverage areas of this present invention. In particular, the non-circular coverage area 64 of each spray head 32 has a major diameter L2 and a smaller minor diameter W2 that penetrates into the flues 60, 62. The narrow width measure W2 allows spray heads 32 to be stationed closer together along a common supply line 30, which in turn increases chances that multiple spray heads 32 will be activated and thereby apply more water into the flues 60, 62 where a fire plume is growing. Furthermore, water droplet size and water velocity will be increased due to the added water pressure and volume, which large droplet size helps to force more water into the flues 60, 62 against a counter-flow of heat from the fire.

The staggered, interlaced non-circular coverage areas 64 of the fire suppression system 20 will discharge water onto the stored items 54 with a high degree of hydraulic efficiency. Through large scale fire tests, where fire suppressing systems and fire sprinkler components are evaluated in a scientific setting, fire control has been proven to be most effective by maximizing the following system variables: water discharge velocity, k factor and water droplet size. Fire control is typically improved by: greater water velocity, higher k factor and/or larger water droplet size. The elongated nature of each coverage area 64, where the major diameter (L2) is significantly greater than the minor diameter (W2), produces a pattern that more closely mimics a fire hose stream projected at the fire plume. This, in turn, produces larger water droplet size and increases water discharge velocity, while operating at less pressure and volume. Larger water droplets are beneficial because they are less sensitive to the heat rising through the flues 60, 62. That is, larger droplets better penetrate through the flues 60, 62 to reach the fire. Likewise, higher velocity water spray coupled with greater water density also penetrates the narrow flues 60, 62 as compared with a slower moving, lower density water spray as in prior art systems.

The relatively narrow widths W2 (minor diameters) of the coverage areas 64 advantageously enables relatively close spacing (S) of the fire sprinklers 32 along the supply line 30. This close spacing (S) of heads 32 along the same side of the same supply line 30 provides numerous key benefits, perhaps chief among which is an improved ability to penetrate the fire flues 60, 62. The unique opposite-facing design utilizing side-discharge style fire sprinklers 32 enables a more precise aim directly into the fire flues 60, 62 thus resulting in a more efficient fire suppression system with the sprayed water in large quantities going where it is most needed. Furthermore, the close spacing interval (S) between sprinkler heads 32 along the same side of the same supply line 30 encourages a condition where more sprinkler heads 32 in the vicinity of a fire are activated rather than fewer. Multiple activated spray heads 32 will have a greater chance of avoiding obstructions and a greater chance of penetrating the fire flues 60, 62 because of the tighter spacing. That is to say, because two or three spray heads 32 are more likely to be initially activated when in the past only one spray head is initially activated, any physical obstructions—like low beams 24, structural columns, equipment or atypically large objects—will not be as likely to block the initial water spray in cases whether the obstruction is between one spray head 32 and the fire. Not to mention, greater distance between adjacent supply lines 30 improves the probability that each supply line 30 can be placed in its own bay between adjacent beams 24 as shown in FIGS. 3 and 4 where they will not be as susceptible to blockage by low-hanging beams 24.

Furthermore, multiple activated spray heads 32 that discharge long, narrow streams of water like a firehose will better attack a fire in the deep interior regions of stacked stored items 54 via the only direct avenues—the flues 60, 62. Even using spray heads 32 with a smaller k-factor fed by lower line pressure, it was shown (above) that larger water distributions (gallons/sq. foot) are possible because the coverage areas 64 are smaller by comparison to prior art ESFR systems. The long, narrow coverage areas 64 are not only accurately aimed toward a fire, but also naturally produce larger water droplets via the design of the deflector which effectively produces an outflow like a jet stream. As a result, water is delivered in a greater density into the flues 60, 62, where it is most-needed. This hose stream effect also works as a fire stop because the water and the droplet sizes are denser. This invention, which may be understood as subscribing to a "spot density theory," goes against the way conventional heads 68 are built, which is on the basis of density (volume/area). Those of skill in the art will acknowledge that there are many shortcomings of the prior art paradigms which place a high premium on density—that is, on blanketing the entire footprint of the storage area with a balanced density of water. In contrast, the spot density theory advanced here allows an early onset fire to be quickly blocked from growing by the targeted coverage area(s) 64 produced by one or more activated spray heads 32 of this invention. Accordingly, early stage fire suppression success rates will increase based on the principles of this invention.

Figure 10:
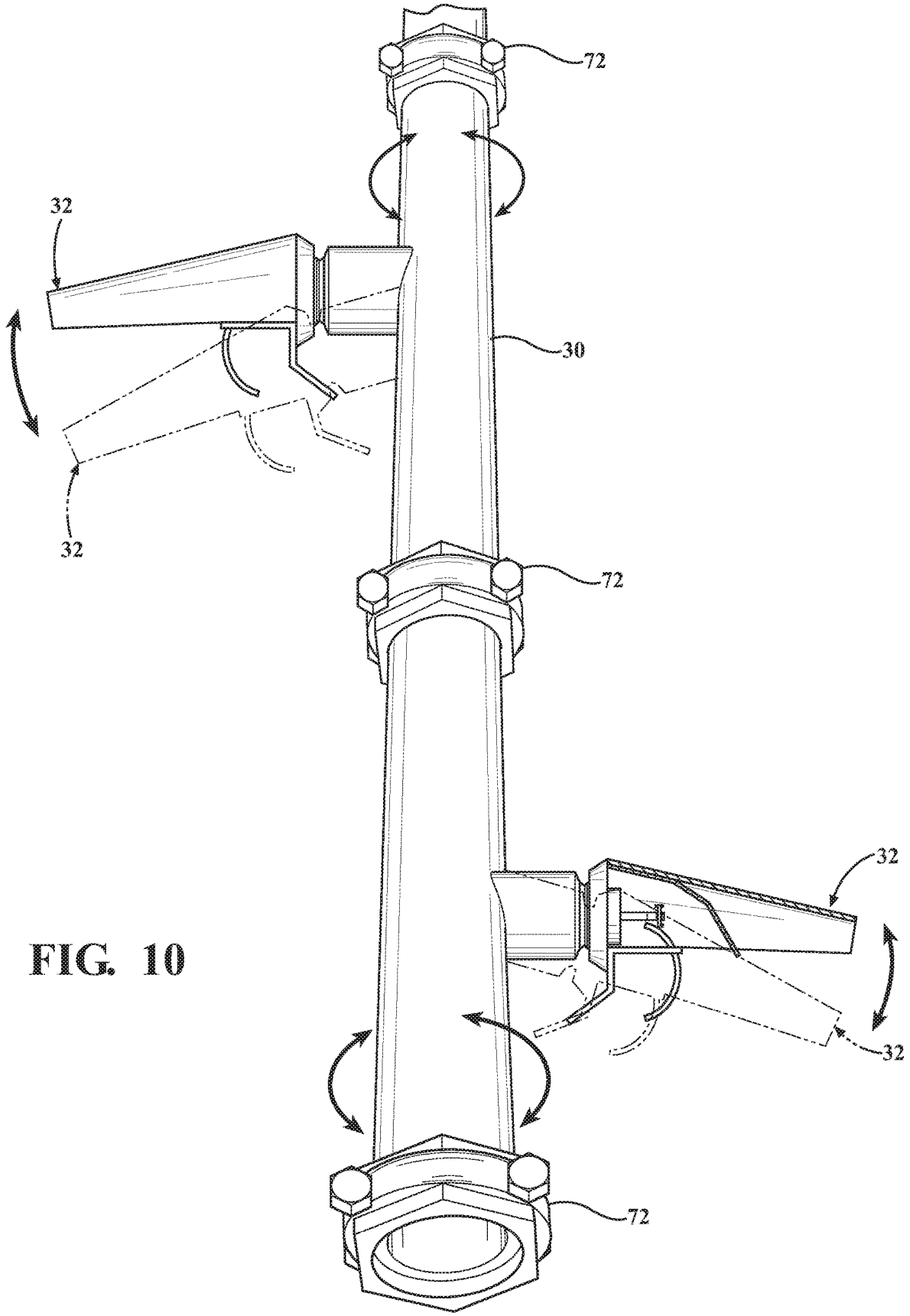
FIG. 10 is a perspective view as in FIG. 4 but showing an optional adjustment scheme whereby the coverage patterns can be individually adjusted to suit the storage conditions.

FIG. 10 describes an alternative embodiment wherein the supply line 30 is composed of multiple short sections joined end-to-end by couplings 72. The couplings 72 may be any commercially available type, such as the grooved pipe joining technology marketed by the Victaulic Company of Easton, Pa. to name but one possible source. Alluding back to FIG. 4, where by phantom lines it was described that a sprinkler 32 may be skewed relative to horizontal as an alternative to adjusting its deflector in order to achieve a desire placement of the coverage area 64, FIG. 10 represents a method by which adjustment can be accomplished after placement of the sprinkler 32 and without altering its deflectors. In the Applicant's U.S. Pat. No. 9,381,386, attention is given to the concept of configuring and arranging the coverage areas 64 relative to the overall height and location of the stored items 54 so that, at all stages of a fire but particularly at the initial stages, a maximum amount of water is applied to the flues 60, 62 laying directly above the fire so that very little spray is wasted dousing nearby (non-burning) stored items. For all of the reasons therein described, it is desirable to install the present fire suppression system 20 so that the coverage areas 62 are matched to the height and location of the nearby stored items 54. However, over time the owner of a storage space is likely to change the height and/or location of the stored items 54, such that the alignment of coverage areas 64 becomes outdated. By loosening the couplings 72 at each end of a section of supply line 30, the supply line 30 can be rotated and with it the sprinkler head 32 carried thereon. By careful attention, the coverage area 64 of each spray head 32 can be adjusted whenever there is a change in the height and/or location of the stored items 54 in order to achieve the benefits and objectives explained in U.S. Pat. No. 9,381,386. In another contemplated variation, the saddles 34 may be custom-attached to the supply line 30 at fixed downwardly-skewed angles to achieve an aimed but non-adjustable configuration similar to that depicted in FIG. 10. That is to say, a pre-determined coverage area 64 can be accomplished by setting the saddles 34 at the desired angles at the time of fabrication, thereby achieving skewed spray head positioning without use of couplings 72.

Referring now to FIGS. 11-22, an alternative embodiment of the fire suppression system is described in which the sprinkler system is composed of a series of three-head arrays 100. Each three-head array 100 comprises a repeating group, or cluster, of three consecutive sprinklers placed at regularly-spaced intervals along the length of the supply line 108. The arrays, or clusters, are generally identical, and form a recurring pattern along the length of the supply line 108. So, as an example, if the supply line 108 is forty-feet long and each three-head array 100 occupies four feet of length, the supply line 108 will support approximately ten three-head arrays 100. Of course, the length of a three-head array 100 can be longer (or shorter) than the suggested four feet. Each three-head array 100 comprises a vertical-discharge sprinkler 102 and two side-discharge sprinklers 106. The combination of vertical 102 and side 106 discharge sprinklers has significant advantages, as will be described. Water from the vertical-discharge sprinkler 102 has the ability to penetrate a fire plume that is located directly under the supply line 108 faster than will the water from either side-discharge sprinkler 106, and also produces a beneficial chilling effect that helps control the premature triggering of adjacent sprinkler heads. Therefore, when a fire is directly below (or nearly directly below) the supply line 108, water from the vertical-discharge sprinkler(s) 102 can quickly wet the relevant coverage area, which may be helpful to retard the spread of the fire.

Figure 30:
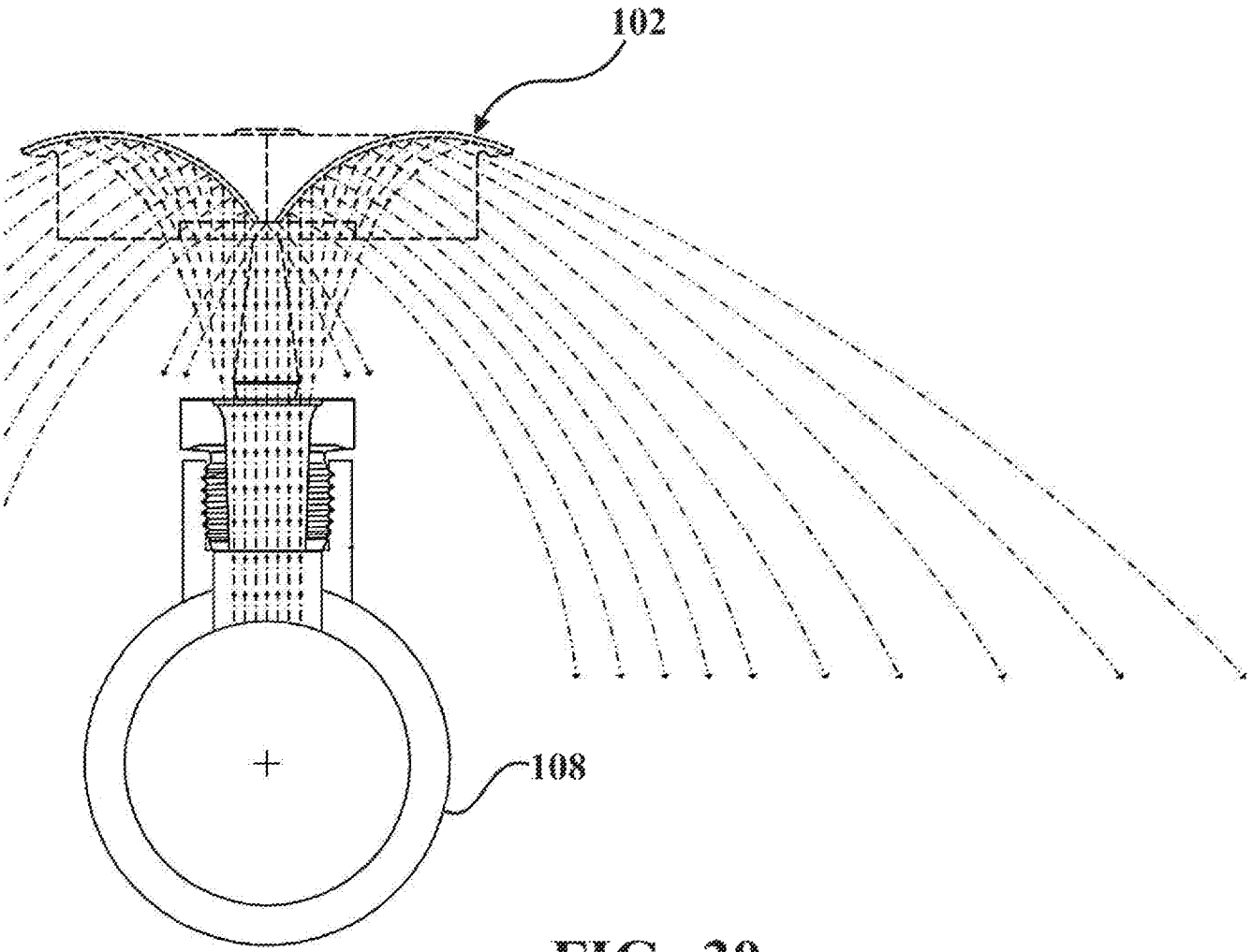
FIG. 30 shows a vertical-discharge sprinkler oriented vertically pointing up.

FIGS. 11-13D depict one exemplary three-head array 100 for the fire suppression system 100. In this example, the vertical-discharge sprinkler 102 is of the pendant-type directly coupled with the supply line 108, and oriented vertically pointing down. It is contemplated that the vertical-discharge sprinkler 102 could instead be oriented vertically pointing up as shown in FIG. 30, which in certain applications may be preferred to the downward-pointing orientation shown in FIG. 11. The vertical-discharge sprinkler 102 includes a heat collector 104, in the form of a bell-shaped shroud. The heat collector 104 provides several benefits. As the name implies, the heat collector 104 helps concentrate heat rising and/or radiating from a fire to provide early activation for a trigger (or fuse) 109 of the vertical-discharge sprinkler 102. The heat collector 104 also acts as a blocking surface, or shield, against cold-soldering from the water spray 110 of adjacent spray heads that may have been earlier activated. The heat collector 104 also facilitates, to a degree, directional control of the water 110 discharge pattern produced by the vertical-discharge sprinkler 102. One exemplary embodiment of the heat collector 104 is made by forming a non-flammable material, such as metal, into a circular frusto-conical shape. The size and shape of the heat collector 104 can be varied depending on the preferred coverage shape and size of the discharge pattern. In another example, the heat collector 104 could be parabolic, with the trigger 109 being generally located at the parabolic focal point like a radio signal antenna. Or the heat collector 104 could be modelled in the spirit of a Fresnel reflector, with multiple internal facets each reflecting radiant heat toward the trigger 109. Naturally, many alternative configurations are possible.

Figure 11:
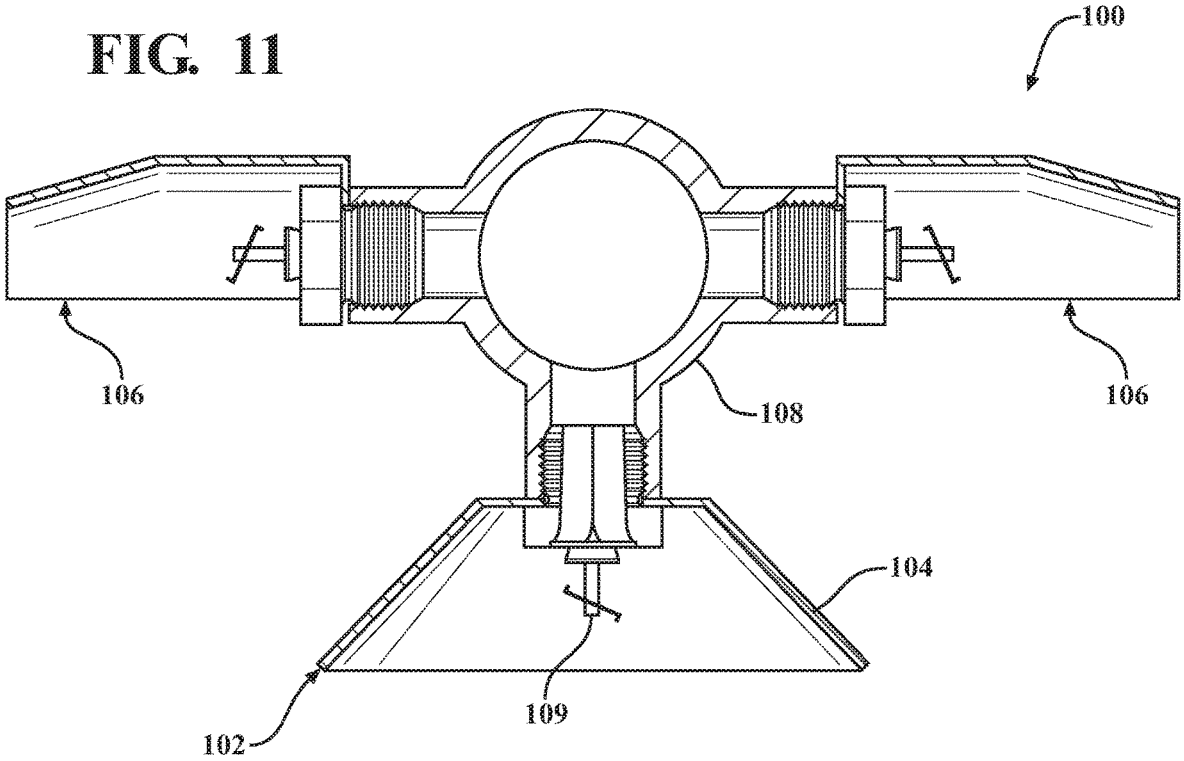
FIG. 11 is a cross-sectional view of a three-head array portion in a fire suppression system comprising two oppositely-facing side-discharge sprinklers and one vertical-discharge sprinkler, according to one embodiment of the present invention.
Figure 12:
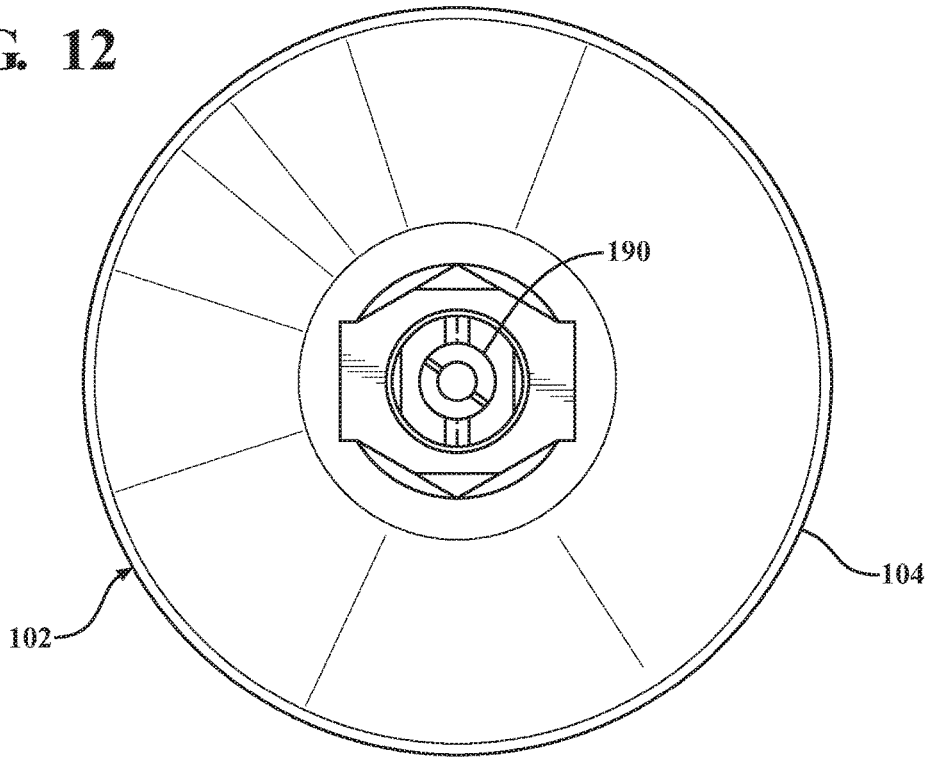
FIG. 12 is a bottom view of the vertical-discharge sprinkler depicted in FIG. 11.

A bottom view of the vertical-discharge sprinkler 102 is depicted in FIG. 12. Although shown in FIGS. 11-12 as a smooth-sheet-like conical member, the heat collector 104 may be specially configured to accentuate its heat collecting properties and/or its discharge pattern shaping properties. For one example, the heat collector 104 may be designed with a thermal pin (or fin) structure that enhances the trigger activation time by channeling the collected heat toward the trigger/fuse 109. Or the heat collector 104 could be designed with reflecting surfaces that intensify the radiant heat directed at the trigger/fuse element 109. Other variations are also certainly possible to accelerate trigger 109 response time via enhanced conduction, convection and/or radiant heat transfer in the event of a fire.

The vertical-discharge sprinkler 102 is shown in FIGS. 11-12 fitted with a trigger 109 in the form of a fusible link. Naturally, any suitable type of trigger 109 can be used. Notably absent from the vertical-discharge sprinkler 102 is any form of in-stream deflector feature to spread the discharge water 110 as in conventional pendant spray heads. While it is possible to incorporate a more traditional in-stream deflector feature (as in the embodiment of FIG. 21), the vertical-discharge sprinkler 102 may be configured to provide a directional discharge pattern controlled chiefly by the shape of its discharge orifice and by the heat collector 104. In this manner, a relatively large, dense concentration of water 110 can be sprayed over a fairly defined coverage area directly below the supply line 108.

In appropriate applications, the response time to activate the trigger 109 can be pre-determined by selecting a fusible link 109 for the vertical-discharge sprinkler 102 that has a higher or lower activation temperature that the respective triggers of the side-discharge sprinklers 106. In one configuration, graphically illustrated in FIG. 14, the trigger temperature of the vertical-discharge sprinkler 102 can be configured to be lower than that of the two side-discharge sprinklers 106 so that the vertical-discharge sprinkler 102 will activate earlier than the two side-discharge sprinklers 106. That is to say, the temperature-sensitive trigger for each side-discharge fire sprinkler 106 is configured to activate at a predetermined temperature $T_h$, and the temperature-sensitive trigger 109 for the vertical-discharge fire sprinkler 102 is configured to activate at a predetermined temperature $T_v$ which is lower than the predetermined temperature $T_h$ of the side-discharge fire sprinklers 106. This configuration enables a quickly concentrated discharge of water 110 to be initially sprayed below the supply line 108 by the vertical-discharge sprinkler 102. Because only one vertical-discharge sprinkler 102 is flowing in this scenario, maximum water pressure and water flow is sprayed downwardly onto the fire. As a result, it is possible that the fire could be preemptively suppressed by just the vertical-discharge sprinkler 102. I.e., without triggering either of the side-discharge sprinklers 106. By delaying activation of one or both side-discharge sprinklers 106 in this scenario, the water flow and pressure that the side-discharge sprinklers 106 would otherwise consume is conserved for the benefit of the one activated vertical-discharge sprinkler 102. Depending on the desired water coverage areas, the temperature of the fusible link 109 can be determined by test or simulation.

Continuing still in the example of FIGS. 11-12, the three-head array 100 includes two side-discharge sprinkler heads 106 arranged directly back-to-back. Each side-discharge sprinkler head 106 may be substantially identical to those described above in connection with FIGS. 2-10 with one exception: the down wash section 46 may be omitted or modified. In this embodiment, the vertical-discharge sprinkler 102 obviates the need to divert some or all water 110 directly below and behind the supply line 108, which was a primary purpose of the down wash section 46. As with the vertical-discharge sprinkler 102, both side-discharge sprinklers 106 may be fitted with a fusible link type trigger. However, any suitable type of trigger can be used in the alternative. A baffle (like the baffle 44 in FIG. 5) may optionally be included inside the nozzle-like hood of each side-discharge sprinkler 106 to create a desired discharge pattern.

Figure 13A:
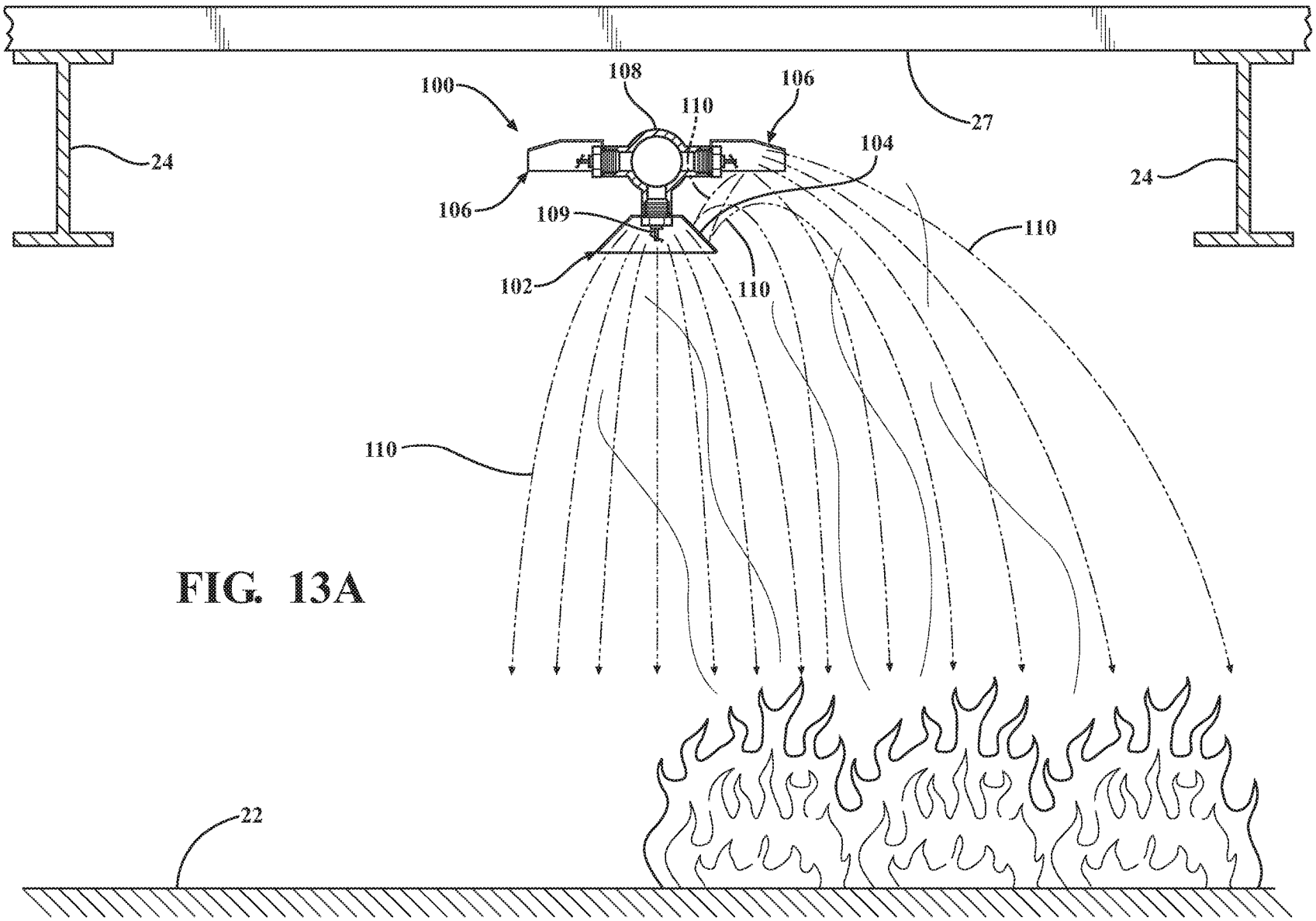
FIG. 13A is a simplified view of the three-head array disposed within a warehouse above an uncontained fire, and in which the vertical-discharge sprinkler and one side-discharge sprinkler have been activated by elevated temperature to suppress the fire.

FIG. 13A is a schematic drawing showing the three-head array fire suppression system 100 in operation in a structure whose roof 27 is supported by widely-spaced I-beams 24 like those commonly found in large storage warehouse facilities. FIG. 13A, which is similar in some respects to FIG. 6, depicts a ground fire located to one side (i.e., the right side) of the supply line 108. The deflectors of the right-side discharge sprinkler 106 and the vertical-discharge sprinkler 102 help concentrate the arising heat so as to readily activate only those two sprinklers while the left side-discharge sprinkler 106 remains un-activated. As described above in connection with FIG. 6, this situation allows a concentrated discharge of water 110 onto the fire with minimal collateral damage or unnecessary water/pressure consumption via the un-activated left side-discharge sprinkler 106. FIG. 13A illustrates the manner in which the water 110 discharged from the right side-discharge sprinkler 106 is reflected on the heat collector 104 like an umbrella. As a result, the heat collector 104 prevents the water 110 from contacting the trigger 109 in the vertical-discharge sprinkler 102 to minimize the chances of undesirable "cold soldering" in the event the right side-discharge sprinkler 106 were to activate before the vertical-discharge sprinkler 102.

Figure 13B:
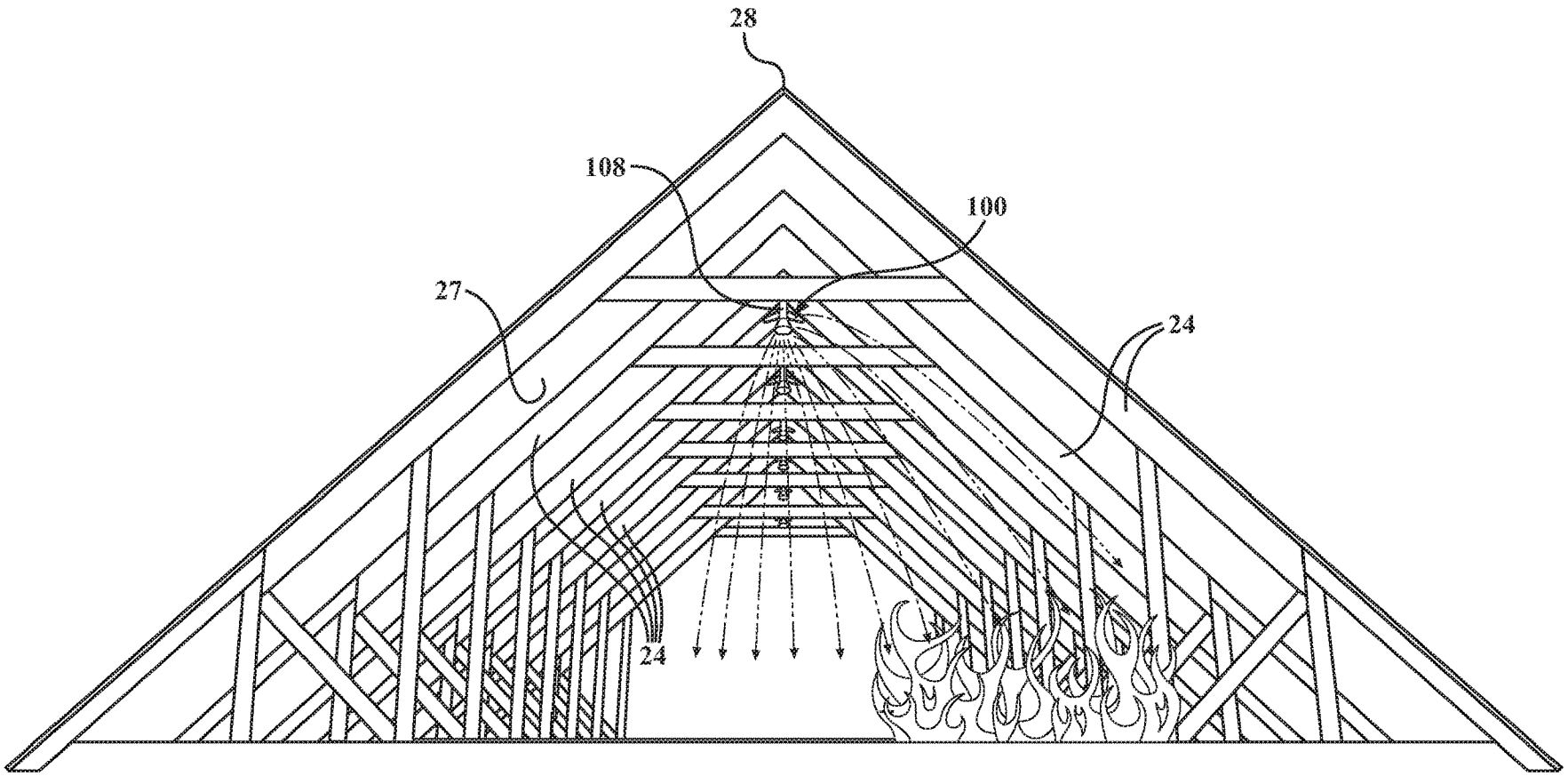
FIG. 13B is a simplified view of the three-head array disposed within an attic space and arranged so that the sprinklers discharge in-between trusses or rafters.

FIG. 13B shows a three-head array fire suppression system 100 in operation in a structure having a roof 27 that is supported by narrowly-spaced beams 24, in the form of rafters or trusses, like those commonly found in attics, sheds, barns and other types of smaller storage facilities. Attic-type applications like this are considered especially high-challenge because the beams 24 and roof 27 are frequently made of wood products. The combustible nature of these structural members adds to the density of combustible items stored in the attic space. As in FIG. 13A, a ground fire is located on the right side of the supply line 108. Water forcefully discharged in narrow-banded streams from one right-side discharge sprinkler 106 and one vertical-discharge sprinkler 102 douse the fire with heavy flows of liquid water. The concentrated discharge of water onto the fire helps to minimize collateral damage while economizing water/pressure consumption. The high-mounted location of the sprinkler array 110, i.e., in close proximity to the roof peak 28, enables the hose stream effect produced by the right and left side-discharge fire sprinklers 106 to wet a greater portion of the exposed combustible framing members 24 and/or combustible roof decking 27 using high-velocity water. It should be noted that the nearer the sprinkler array 100 is to the peak 28, the shallower the angle of incidence between emitted water stream and roof decking 27. A shallower angle of incidence means less deflection of the water stream and thus more surface area that can be wetted. Furthermore, location of the sprinkler array 110 close to the peak 28 where heat naturally collects will improve response times. Thus, in high-challenge applications that are further complicated by combustible framing members 24 and/or combustible roof decking 27, as in pitched-roof attics, the present invention is better suited to retard growth of a fire. Furthermore, the high-velocity wetting effect can, if desired, be designed to use nearby structural features like a pitched roof as a secondary deflector to enable highly-customized water distribution options.

Figure 13D:
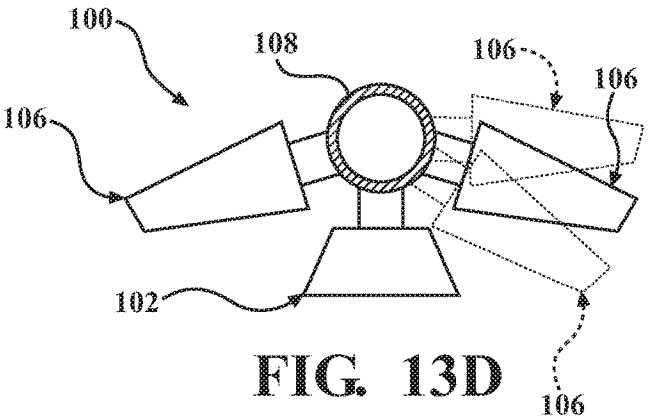
FIG. 13D is an enlarged view of the three-head array of FIG. 13C with one side-discharge deflector shown in different adjusted positions.
Figure 13C:
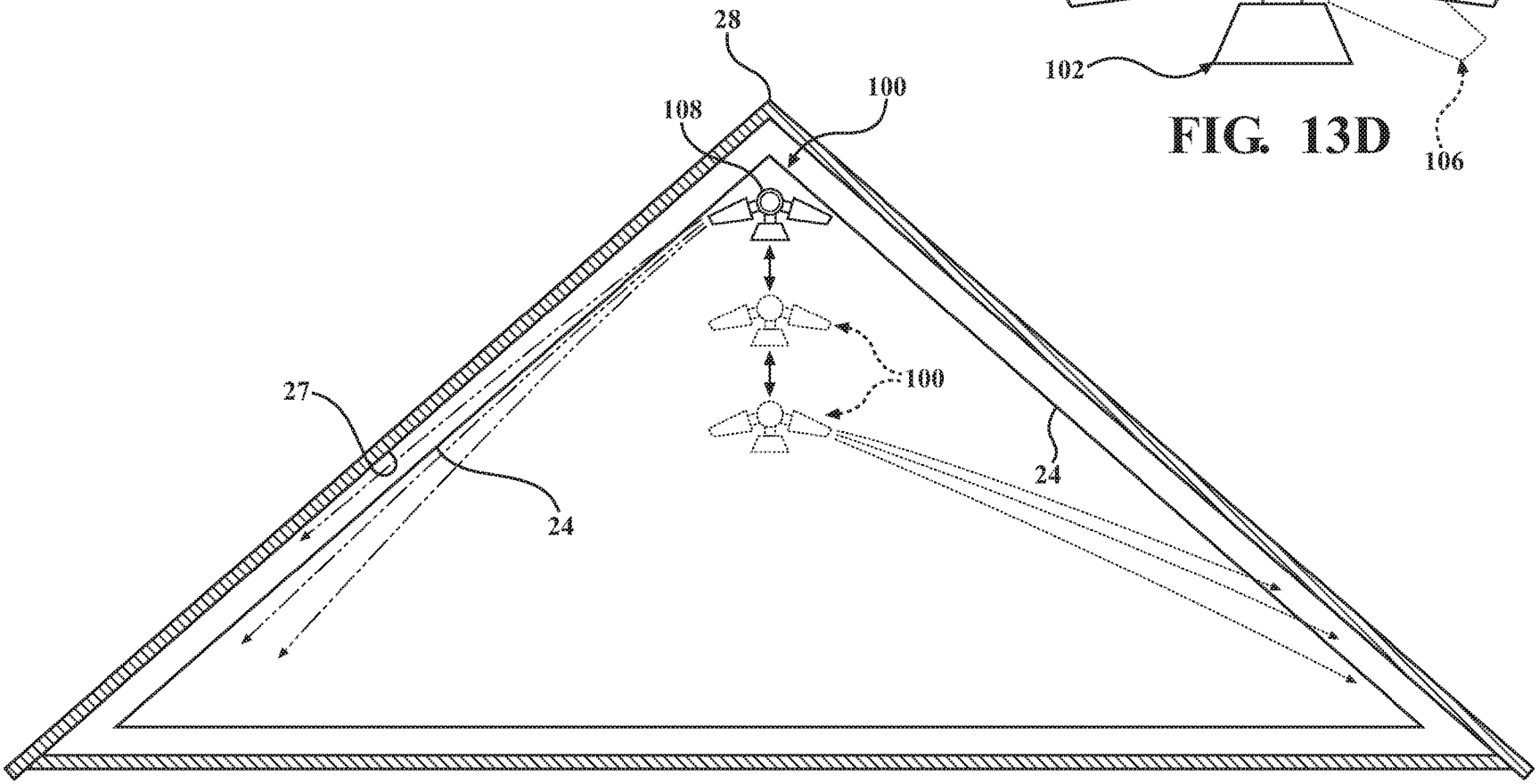
FIG. 13C is a view of an attic installation similar to FIG. 13B and showing various placement options relative to the roof peak in combination with adjustable side-discharge deflectors to enable the roof surface to be utilized as a secondary deflector if desired.

FIG. 13C shows the three-head array 100 of FIG. 13B in a highly-simplified attic installation. In this view, various placement options for the supply line 108 and array 100 relative to the roof peak are illustrated. In combination with adjustable side-discharge deflectors 106, the trajectory of the high-velocity water stream can be aimed to suit the roof pitch and/or accommodate other environmental factors. By locating sprinkler heads capable of emitting a high-velocity water stream in the uppermost peak 28 of a roof 27, many advantages can be realized. For one, the sprinklers 102, 106 can be located very near to where heat naturally collects in the event of a fire. As a result, faster response times for the heat-sensitive triggers are possible. Conversely, if obstructions or other factors make placement near the ridge 28 impractical, lower positions can be accommodated as depicted through the phantom line alternatives. Another advantage of placing the array 100 very near to the peak 28 is that more of the inner roof 27 surface will be wetted. In embodiments where the side-discharge sprinklers 106 are made adjustable, as illustrated in FIG. 13D, a still further advantage is that the side-discharge water streams can be angled for maximum effect. For example, it may be desirable to utilize the inside surface of the roof 27 as a secondary deflector. This is possible by adjusting the deflectors of the side-discharge sprinklers 106. Adjustment of the side-discharge sprinklers 106 can be accomplished by any number of methods. FIGS. 4 and 10 illustrate two different methods. Alternatively, the deflector hoods 42 can be plastically deformed or bent to achieve the desired angle. Or the deflector hoods 42 can be configured with an articulated joint to allow angular adjustment. Naturally, there are many methods by which adjustment of the deflectors can be accomplished after placement of the sprinkler 32 has been installed.

FIGS. 13A-D are thus intended as representative illustrations to show the broad range of applications possible for the teachings and principles of this invention. Indeed, the concepts of this invention are applicable to many types of applications, the most attractive of which are expected to be the various forms of high-challenge storage applications.

Figure 14:
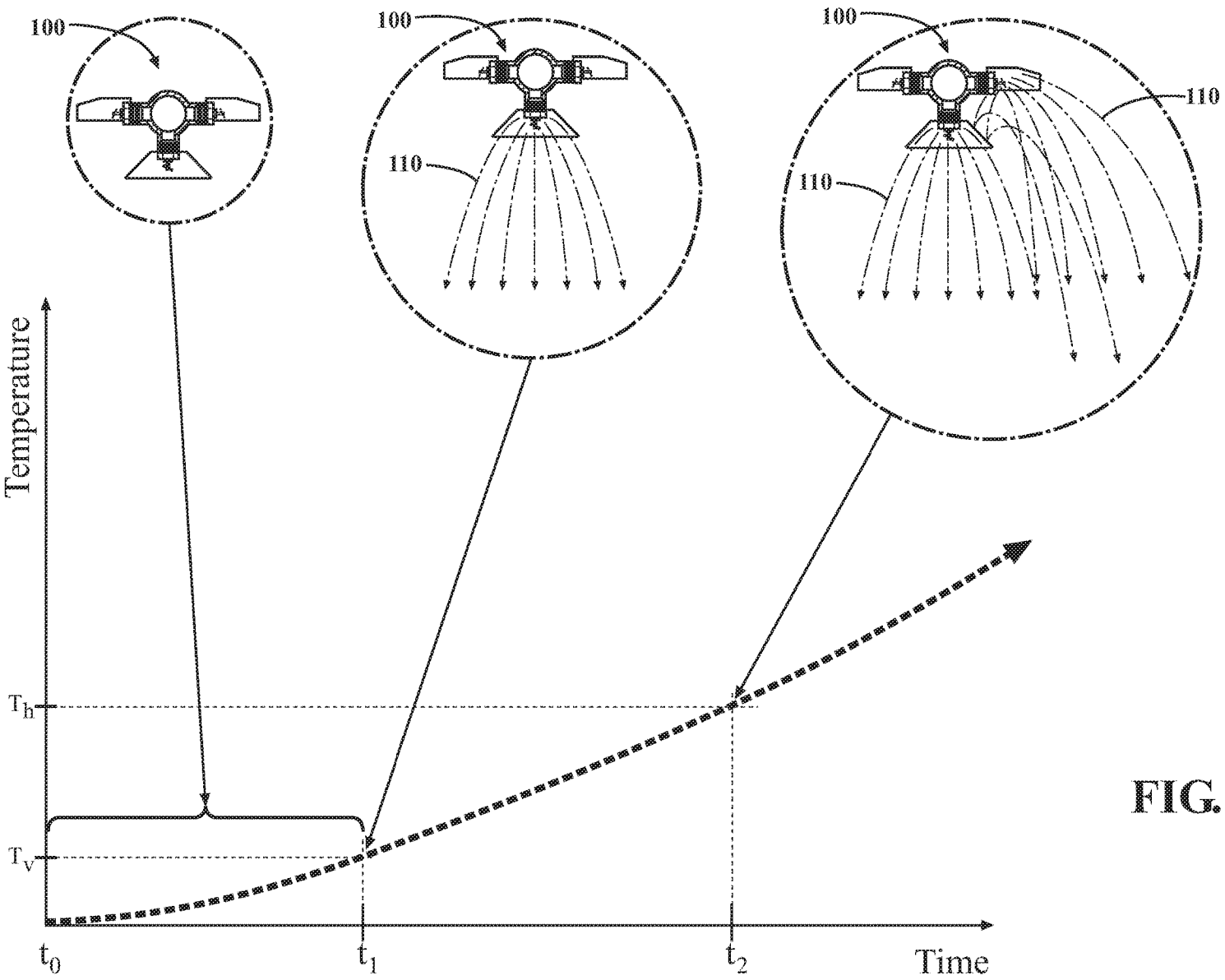
FIG. 14 is a simplified Temperature-Time graph illustrating the temporal responsiveness for two activated sprinkler heads shown in either of FIG. 13A or 13B.

FIG. 14 is a simplified Temperature-Time graph illustrating the responsiveness for one exemplary embodiment of the three-head array fire suppression system 100 shown in any of FIGS. 13A-D. This graphic illustrates the optional configuration in which trigger temperature ($T_v$) for the trigger 109 of the vertical-discharge sprinkler 102 is lower than the trigger temperature ($T_h$) for either of the side-discharge sprinklers 106. As a result, the vertical-discharge sprinkler 102 is designed to activate at time $t_1$, whereas one or both side-discharge sprinklers 106 will not activate until the later time $t_2$. In the time span between $t_1$ and $t_2$, only the vertical-discharge sprinkler 102 is actively spraying water 110 onto the fire below, thus concentrating the water discharge for a period of time before additional side-discharge sprinklers 106 are activated (at $T_h$, $t_2$). If the vertical-discharge sprinkler 102 is successful during the time span to suppress the fire, there is a possibility that water damage to collateral objects and property can be avoided. Water spray from the vertical-discharge sprinkler 102 will create cooling effect that will keep the nearby side-discharge sprinklers 106 from firing too soon.

Figure 15:
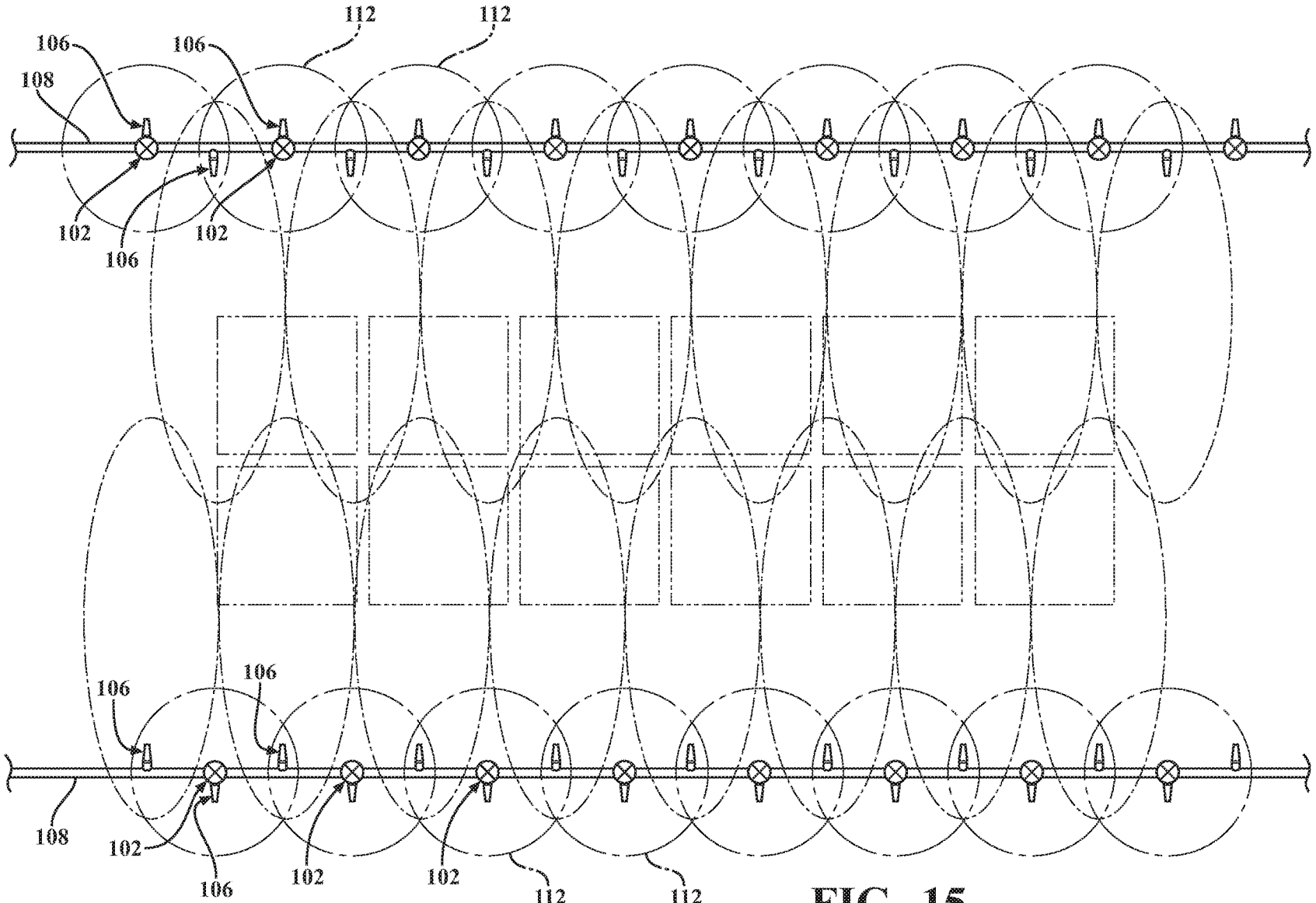
FIG. 15 is a top view as in FIG. 8, in which two parallel supply lines are arranged over a row of stored items, and each supply line supporting sequentially-repeating arrays of three sprinkler heads, in which for each array the two side-discharge sprinklers are staggered from one another and the vertical-discharge sprinkler is located directly below one of the side-discharge sprinklers.

FIG. 15 corresponds generally to FIG. 8 and demonstrates a variation in which the side-discharge sprinklers 106 are stagger-spaced along the supply line 108. The vertical-discharge sprinklers 102 in this example are installed directly below every other side-discharge sprinkler 106. In this configuration, the coverage areas 112 from the vertical-discharge sprinklers 102 fill below the respective supply lines 108 and in-between the elliptical coverage areas from the side-discharge sprinklers 106. Of course, the size and distribution of the pendant coverage areas 112 can be modified to suit the application. The long, narrow reach of the side-discharge sprinklers 106 is designed to reach forcefully into the flues 60, 62 (FIG. 7) in much the same way as the directed discharge from a hand-held fire hose might penetrate into the interior regions of stored items 54 stacked in storage racks 56 where the locus of a fire typically occurs. The vertical-discharge sprinklers 102, on the other hand, produce a predominantly downward (vertical) spray pattern which, when triggered before the adjacent side-discharge sprinkler heads 106, creates the aforementioned cooling effect with beneficial results.

Figure 16:
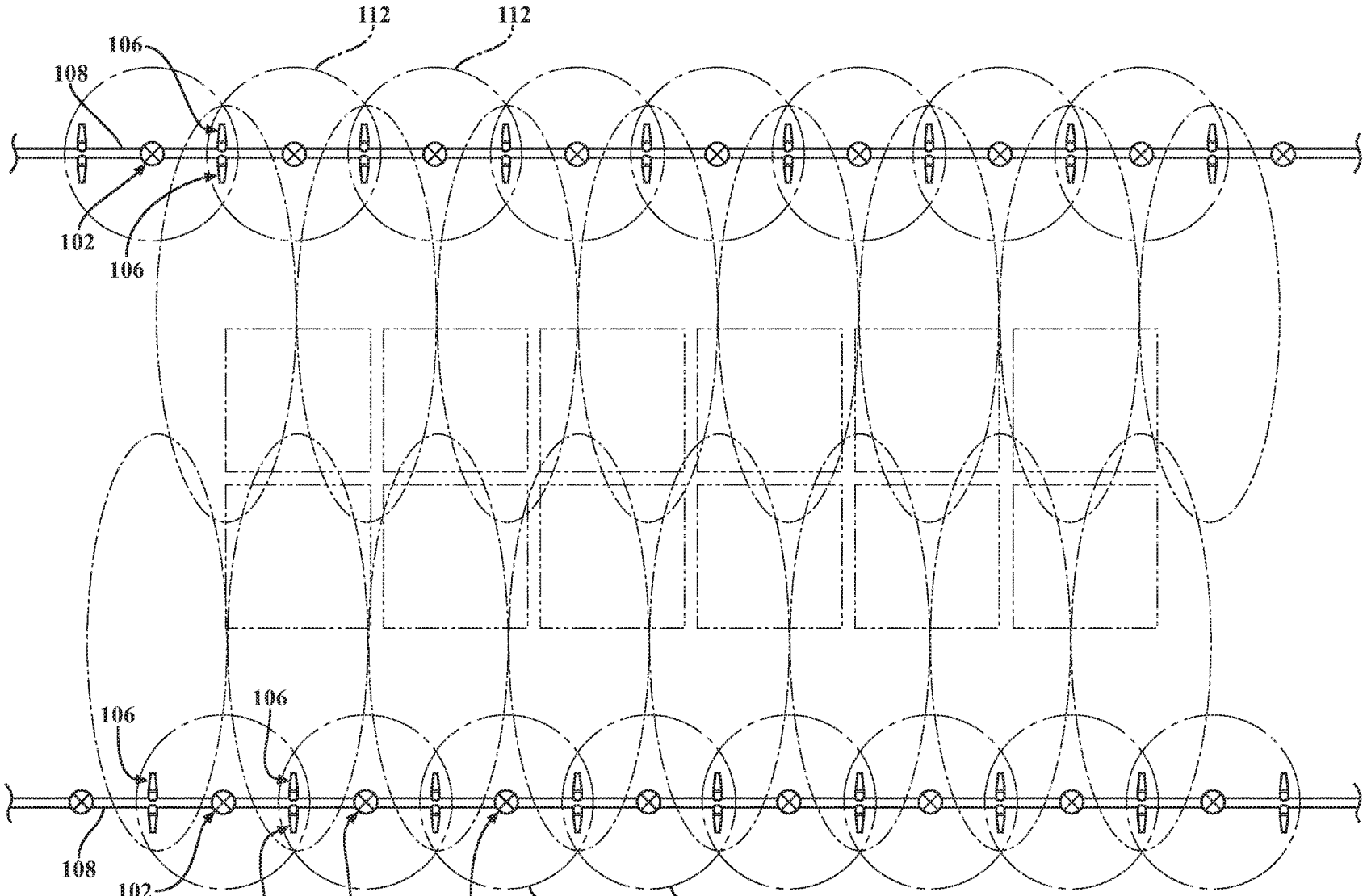
FIG. 16 is top view like FIG. 15 but of yet another alternative configuration in which each three-head array comprises two side-discharge sprinklers located directly opposite one another in back-to-back fashion and the associated vertical-discharge sprinkler is spaced about one-half the interval distance to the side-discharge sprinklers in the next adjacent array.

FIG. 16 is a view similar to FIG. 15, but where the two side-discharge sprinklers 106 in each array 100 are arranged directly opposite one another along the supply line 108. In this example, the vertical-discharge sprinkler 102 is positioned half-way toward the next adjacent group of side-discharge sprinklers 106 in the adjacent array 100. As in FIG. 15, the coverage areas 112 fill the otherwise un-covered pockets below the supply line 108. And as described above in connection with FIG. 8, the staggering of opposing side-discharge sprinkler heads 106 on adjacent parallel supply lines produces the interlaced non-circular coverage areas 64 that discharge water with a superior hydraulic efficiency. Of course, other configurations are possible in which the three sprinklers heads 102, 106 in each array are arranged along the supply line 108.

Figure 17:
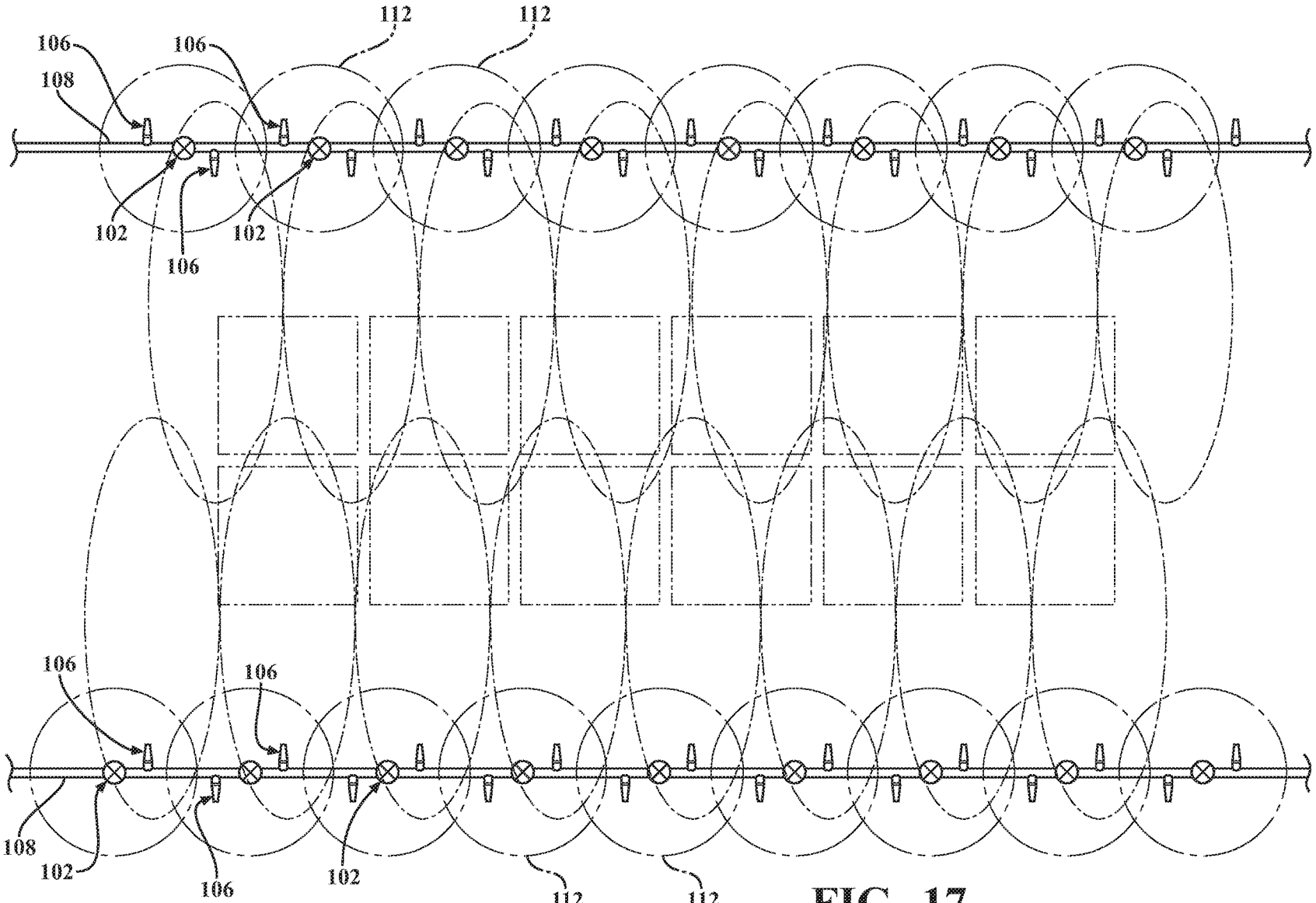
FIG. 17 is top view like FIGS. 15 and 16 but of yet another alternative configuration in which the vertical-discharge sprinkler and two side-discharge sprinklers in each three-head array are all axially-spaced from one another along the supply line.

FIG. 17 is another view similar to FIGS. 15 and 16, but where all side-discharge sprinklers 106 and the vertical-discharge sprinklers 102 are axially offset from one another along the supply line 108. In this fully stagger spaced array 100, the coverage area for each three-head array 100 is subdivided corresponding to targeted areas. As a result, the number of discharge sprinklers 102, 106 can optimized to suppress the fire, and water pressure in the supply line 108 can be maintained even when using a smaller pipe diameter for the supply line 108. The smaller pipe size, eventually, can reduce the labor costs and pipe material costs so that the price of the fire suppression system will be decreased. Additionally, the fully stagger spaced array 100 of FIG. 17 may have manufacturing/assembly advantages, especially when using a smaller diameter supply line 108.

Figure 18:
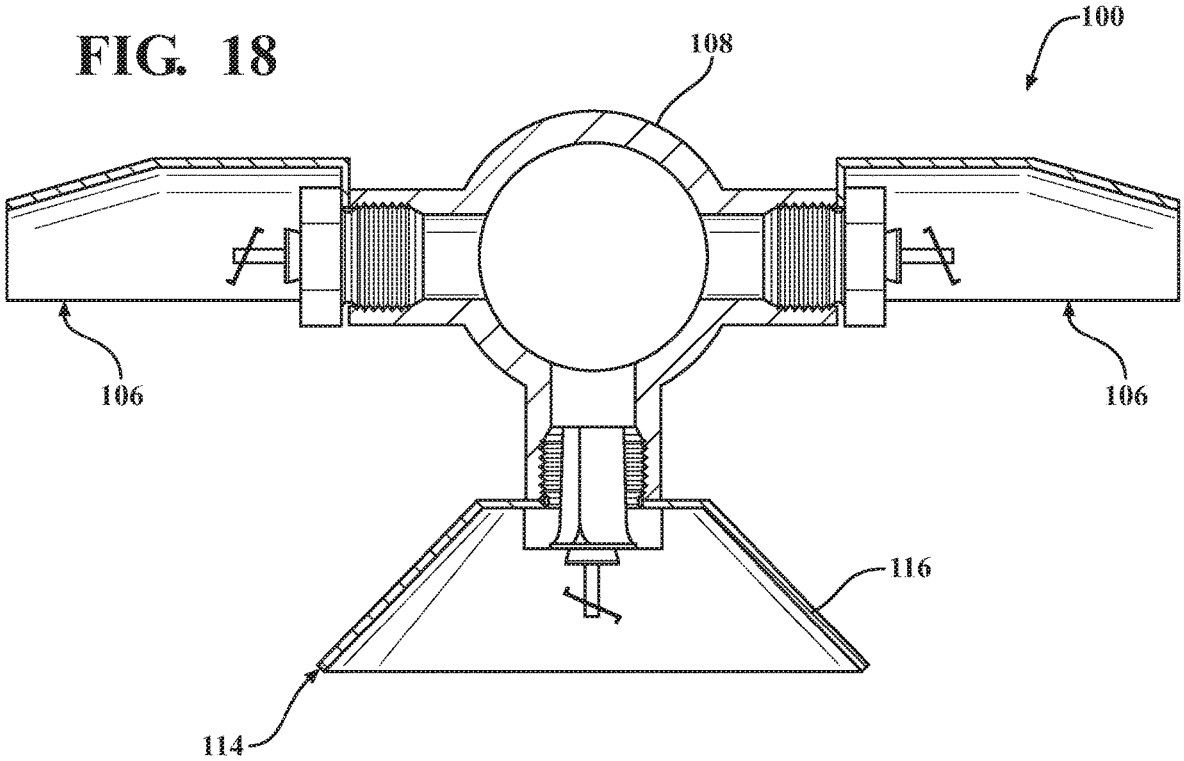
FIG. 18 is a cross-sectional view as in FIG. 11 but showing another variation of the system in which the vertical-discharge sprinkler head is configured to provide water discharge at two unequal flow rates.
Figure 19:
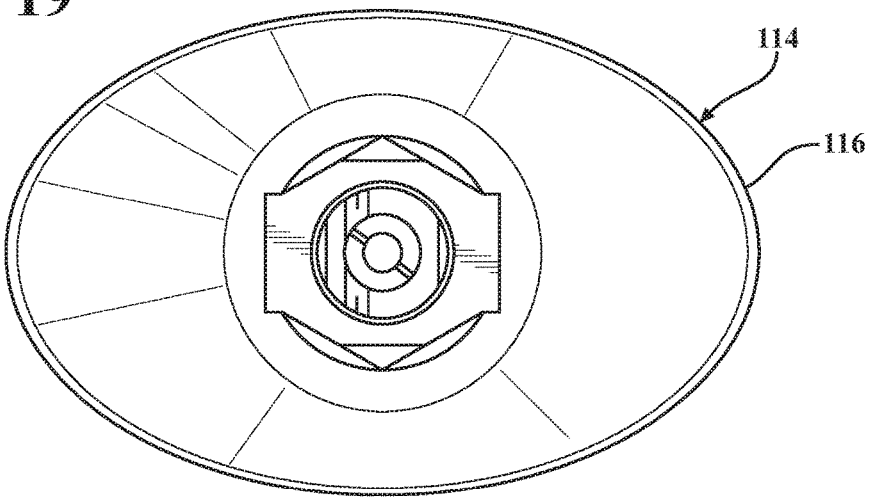
FIG. 19 is a bottom view of the vertical-discharge sprinkler in FIG. 17, and further showing an optional non-circular deflector configuration.
Figure 20:
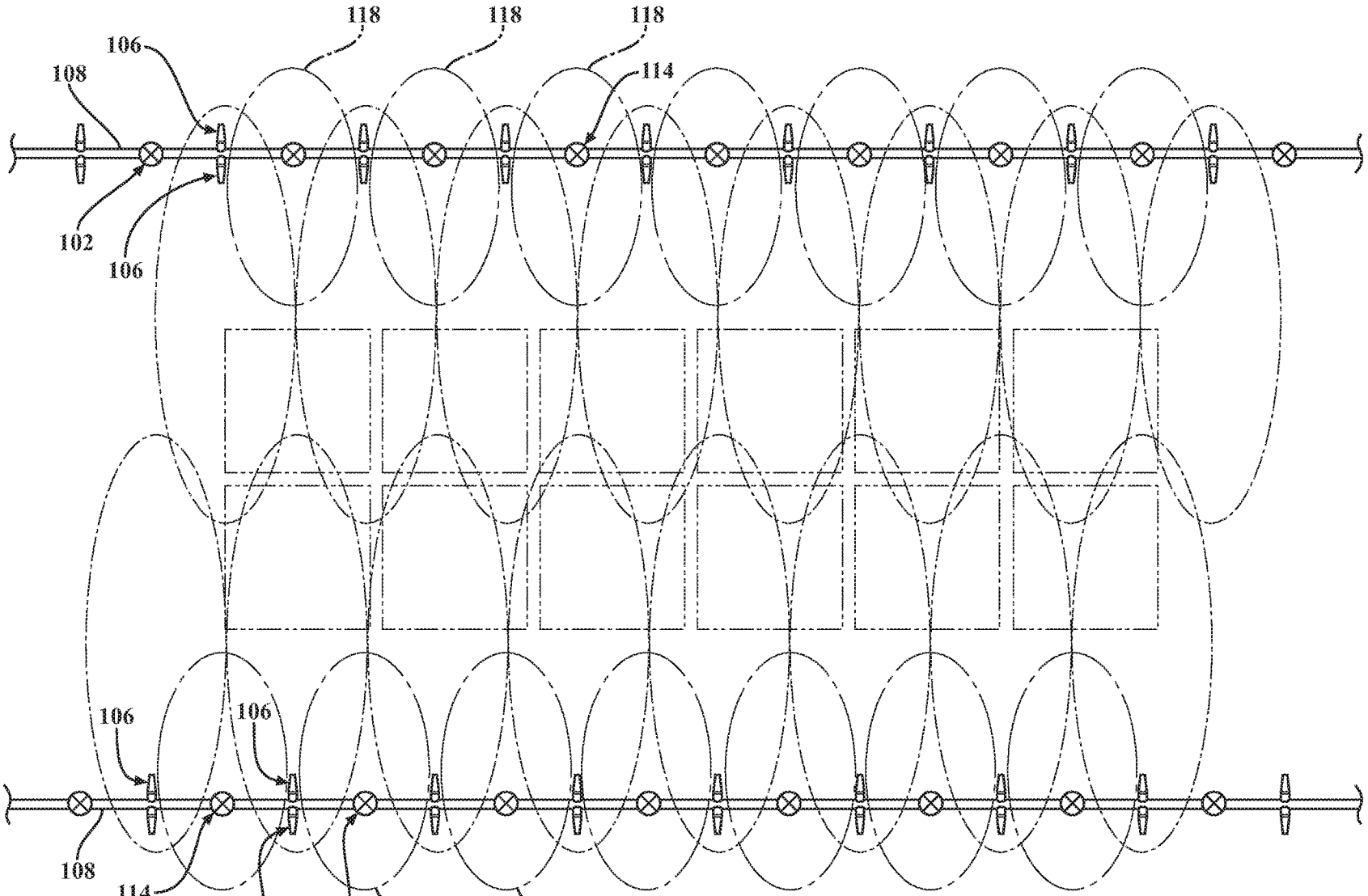
FIG. 20 is a top view as in FIG. 16 in which the vertical-discharge sprinklers are each configured to produce non-circular spray patterns.

FIGS. 18-20 depict yet another alternative embodiment in which a vertical discharges sprinkler 114 is configured to discharge water at two different k-factors: k-factor (A) and k-factor (B). As mentioned above, the k-factor represents a nozzle discharge coefficient. Each vertical-discharge fire sprinkler 114 connects to the supply line 108 through a nipple (see #36 in FIGS. 4 and 5). A flow divider may be located inside the nipple to segregate the outflow of liquid water into at least two unequal streams, one of the streams characterized by first nozzle discharge coefficient (k-factor A) and the other stream characterized a second nozzle discharge coefficient (k-factor B) of unequal magnitude to the first nozzle discharge coefficient (k-factor A). See cross-sectional view of FIG. 18. In this embodiment, k-factor (A) is smaller than k-factor (B) so that a somewhat egg-shaped coverage area 118 can be produced, as shown in FIG. 20. The three-head array fire suppression system 100 with the pendant-type sprinkler 114 can, in some applications, optimize the water usage by strategically distributing the coverage areas 118.

A bottom view of the pendant-type sprinkler 114 is shown in FIG. 18. Notable in this example is an optional non-circular heat collector 116. This demonstrates the aforementioned possibility of altering the shape of the heat collector 116 to control the shape of the coverage area 118 and/or to maximize heat collecting/concentrating characteristics and/or to optimize blocking characteristics in the event of cold-soldering concerns.

Figure 21:
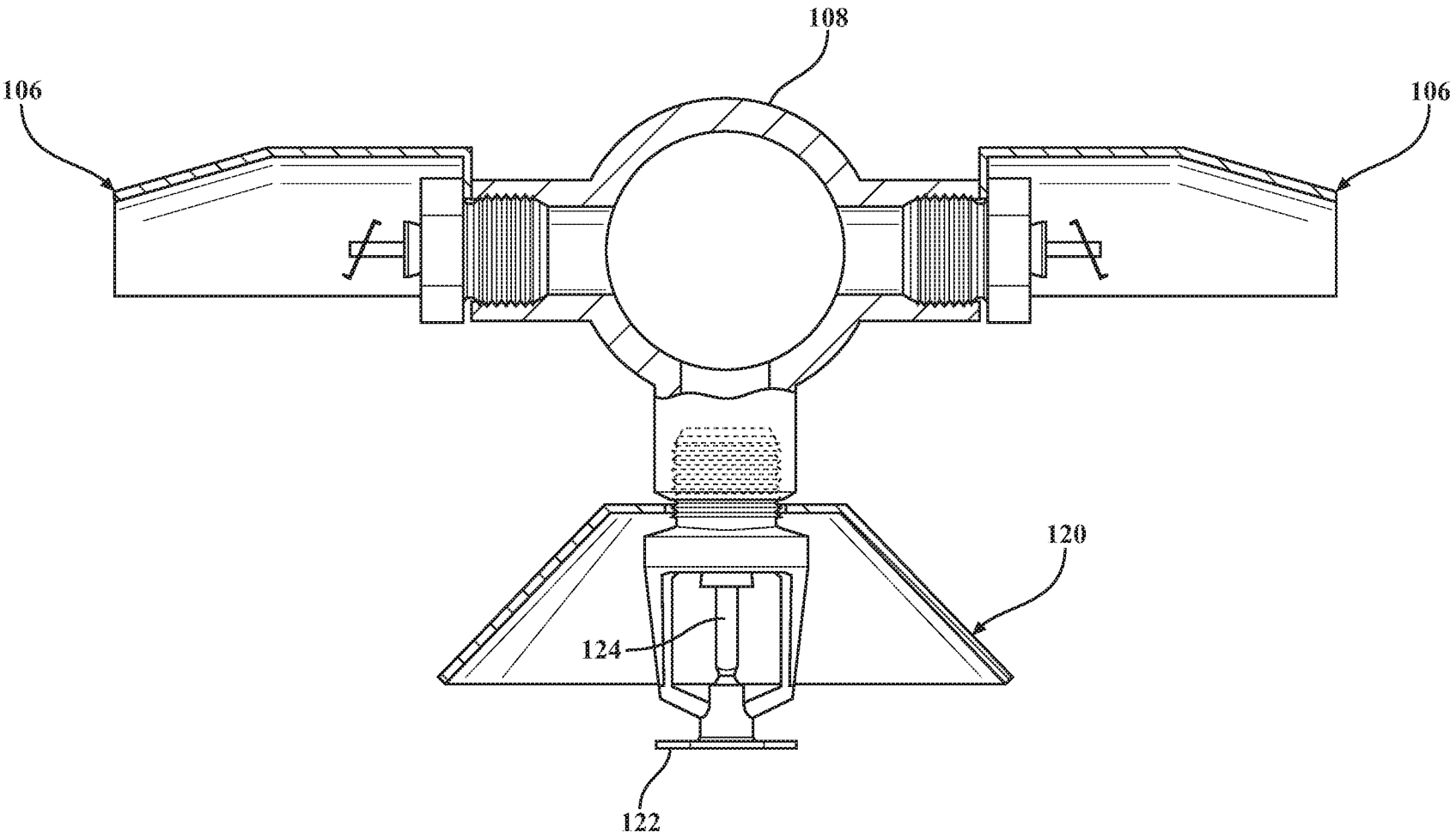
FIG. 21 depicts yet another alternative embodiment in which the vertical-discharge sprinkler has a traditional frame structure with a trigger in the form of a heat-sensitive glass bulb.

Another alternative 120 of a pendant-type sprinkler is shown in FIG. 21. In this view, the pendant sprinkler 120 has a traditional frame structure with an in-stream diffuser 122. Its trigger 124 is in the form of a heat-sensitive glass bulb. This demonstrates the possibility of altering the type of sprinkler head—in not only the pendant but also in the side discharge heads—so that off-the-shelf types can be used, if desired.

Figure 22:
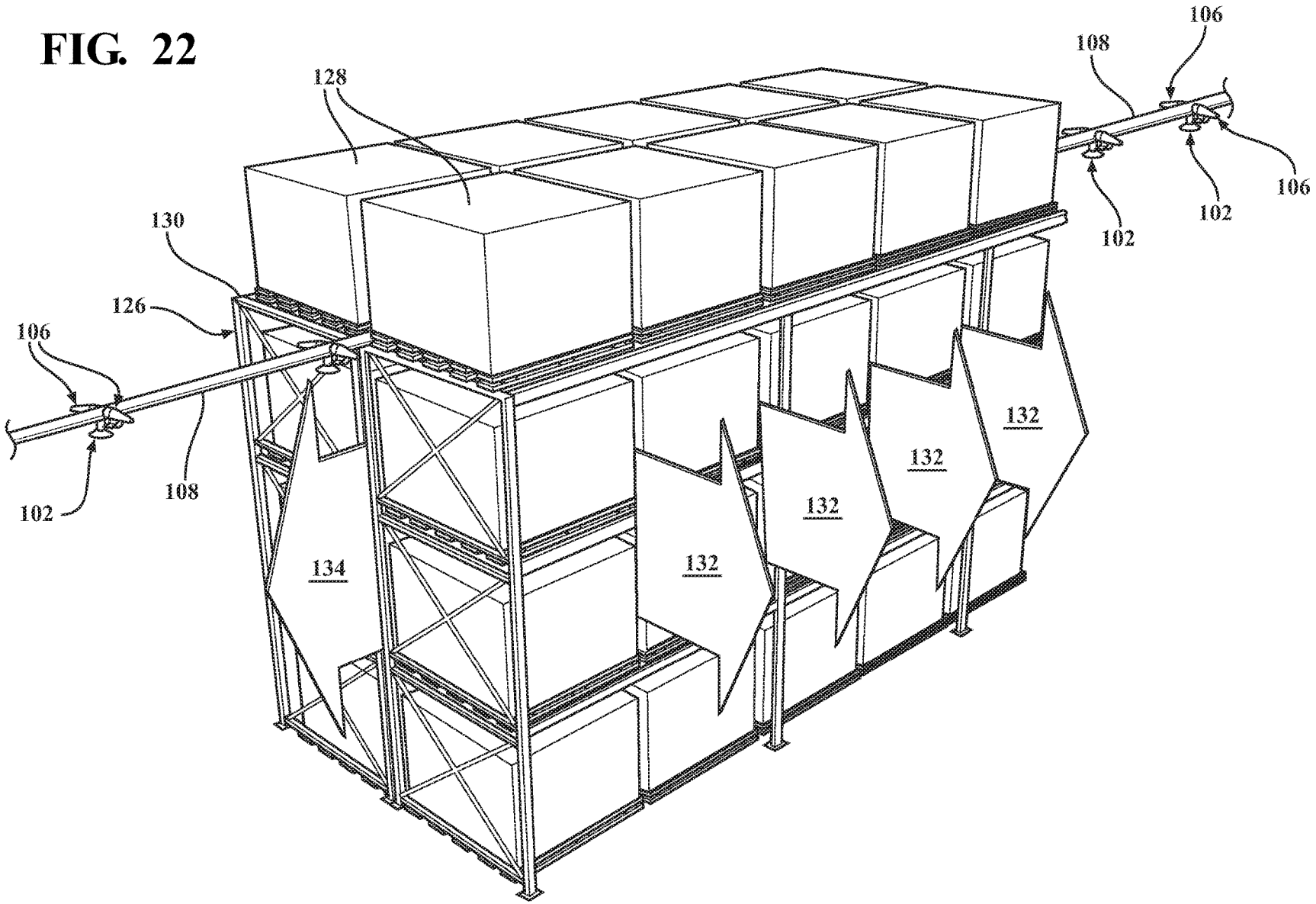
FIG. 22 is a perspective view as in FIG. 7 but showing an alternative embodiment in which the supply line is located within the longitudinal flue of a storage rack and the repeating arrays of three-head sprinkler groups are coordinated with the locations of the transverse flues so as to maximize water placements in the flue corridors.

The three-head array 100 can be installed any place in a warehouse or attic or shed or other area to be protected so as to optimize the fire suppression capabilities. FIG. 22, which corresponds generally to FIG. 7 as described in detail above, illustrates yet another alternative configuration in which the fire sprinkler system is located in one of the flues (e.g., longitudinal flue 134) in a storage rack 126. In this configuration, the supply line 108 is aligned between stored items 128, and the side-discharge sprinklers 106 and the pendent-type sprinkler 102 are arranged between the gap of the stored items 128. The three-head array system on the top level of shelves 130 can effectively intercept a transverse flue 132 or a longitudinal flue 134 formed in the gap of the palletized stored items 128 by discharging a maximum amount of water directly into the flues 132, 134. Naturally, the supply line 108 can be placed any level of the shelves 130 to optimize the fire suppression, and the space between the sprinklers 102, 106 can adjusted to coincide with transverse flues 132, i.e., the regularly-spaced gaps between the stacks of palletized stored items 128. Naturally, the in-rack option depicted in FIG. 22 may be arranged so that the side discharge sprinklers 106 will spray into adjacent racking by missing any structural members in the flue spaces 132, 134.

The embodiment of FIG. 22 can be understood as but another variation on the earlier embodiments, e.g., FIGS. 13A-C, in that the flues correspond to the aforementioned bays between adjacent beams 24. An advantage of this invention is the ability to strategically locate sprinklers 102 and/or 106 into the spaces where fires are most likely to start. Once activated, the sprinklers 102 and/or 106 will discharge forceful jet streams of liquid water into the vicinity of the fire to quickly extinguish the threat with minimized collateral damage. This present invention enables the advantageous combination of multiple orientations of fire sprinklers, thus combining the respective strengths of each to improve fire protection while at the same time saving both material and labor. Furthermore, the novel combining of multiple orientations of fire sprinklers eliminates certain weaknesses inherent in each orientation by itself. As a result, the fire suppression system and method harness the working power of working of multiple orientations of fire sprinklers to produce, in effect, a super fire sprinkler system and method.

Turning now to FIGS. 23-28, yet another alternative fire suppression system is shown including optional lateral heat shields 140. The lateral heat shields 140 enable quicker response times for side-discharge sprinklers 106 facing toward a fire, while delaying the response times for side-discharge sprinklers 106 facing away from a fire. That is to say, the lateral heat shields 140 are passive devices that prevent early discharge from the side-discharge sprinklers 106 pointing away from a fire. As a direct result, water flow/pressure is conserved for the side-discharge sprinklers 106 pointing in the direction of a fire as well as affected vertical pendant sprinklers 102 (or 114, 120).

Figure 23:
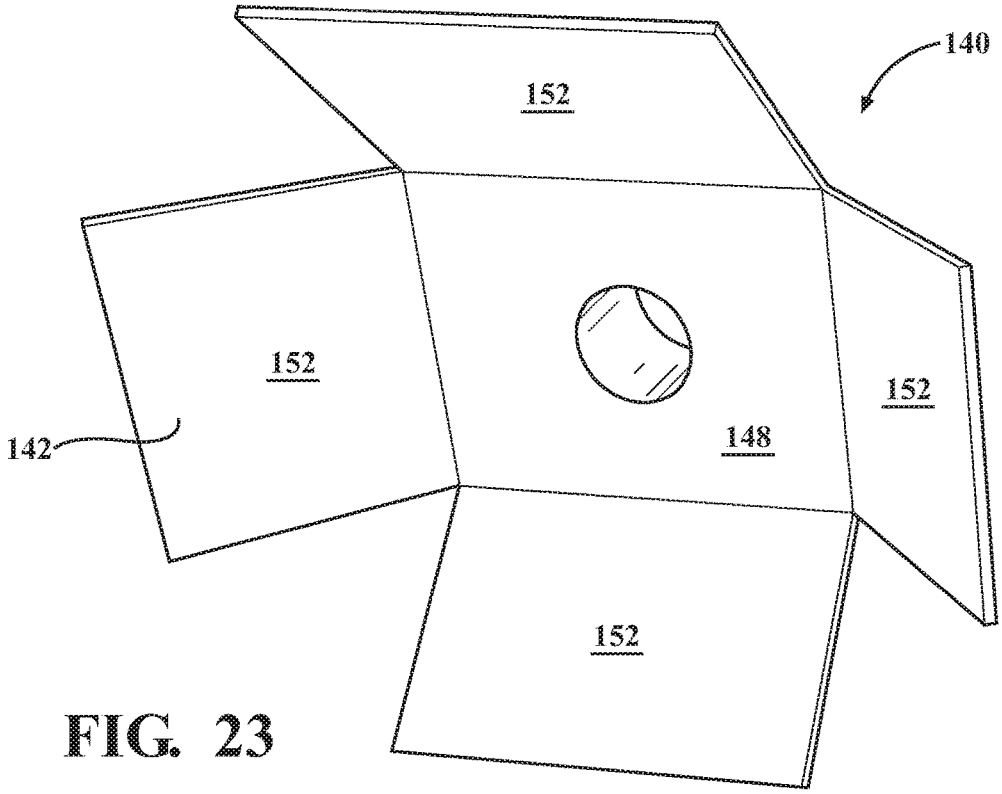
FIG. 23 is a perspective view of a lateral heat shield according to one exemplary embodiment showing its concave heat-concentrating side.
Figure 24:
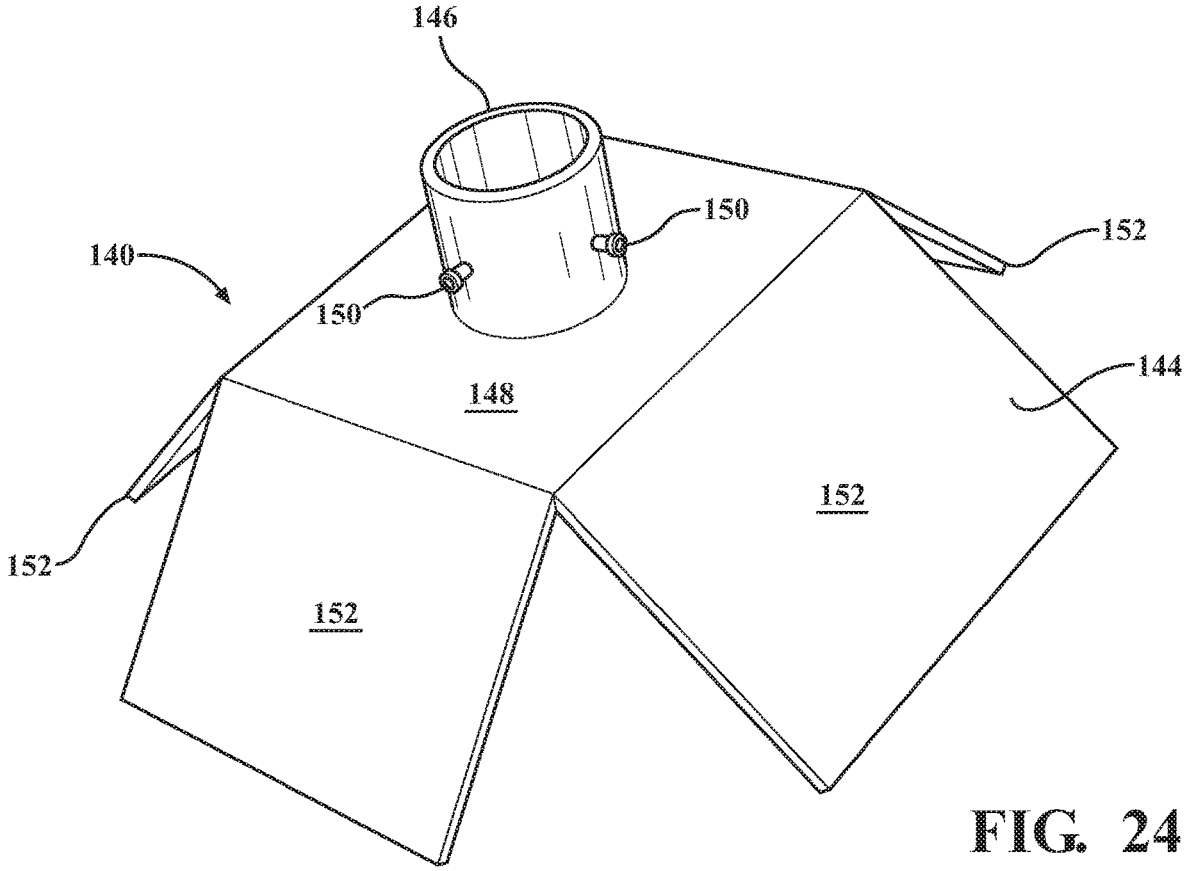
FIG. 24 is a different perspective view of the lateral heat shield of FIG. 23 showing its convex heat-scattering side and connector feature.

The lateral heat shield 140 can take many different forms. In FIGS. 23 and 24, a lateral heat shield 140 is shown in one exemplary configuration having a boxy, flower-like construction somewhat reminiscent of a reflector-style radio antenna. Although a parabolic shape might perhaps be preferred, considerations of manufacturing cost and installation ease tend to favor a simple design. It is contemplated that each lateral heat shield 140 will have a heat-concentrating side 142 (FIG. 23) and a heat-scattering side 144 (FIG. 24). The heat-concentrating side 142 is generally concave, whereas the heat-scattering side 144 is generally convex. The terms concave and convex are used here generally to include a wide variety of shapes, including but not limited to smooth curves and multi-faceted segments, that generally resemble the inside and outside surfaces of a bowl or at least a portion thereof. Both sides 142, 144 are manufactured from suitable material(s) to efficiently reflect radiant heat from a fire. Furthermore, the lateral heat shield 140 should be capable of maintaining its shape at high temperature, and therefore sheet metal compositions (like stainless steel to name one) may be considered better candidates than plastic materials. Of course, any material that provides satisfactory heat reflectivity and temperature resistance could be considered. For example, if cost factors were sufficiently compelling, the lateral heat shields 140 could be made from a high-temperature plastic material coated or clad or impregnated with a reflective substance to achieve the desired radiant heat reflection qualities. Naturally, many material choices are possible.

Figure 25:
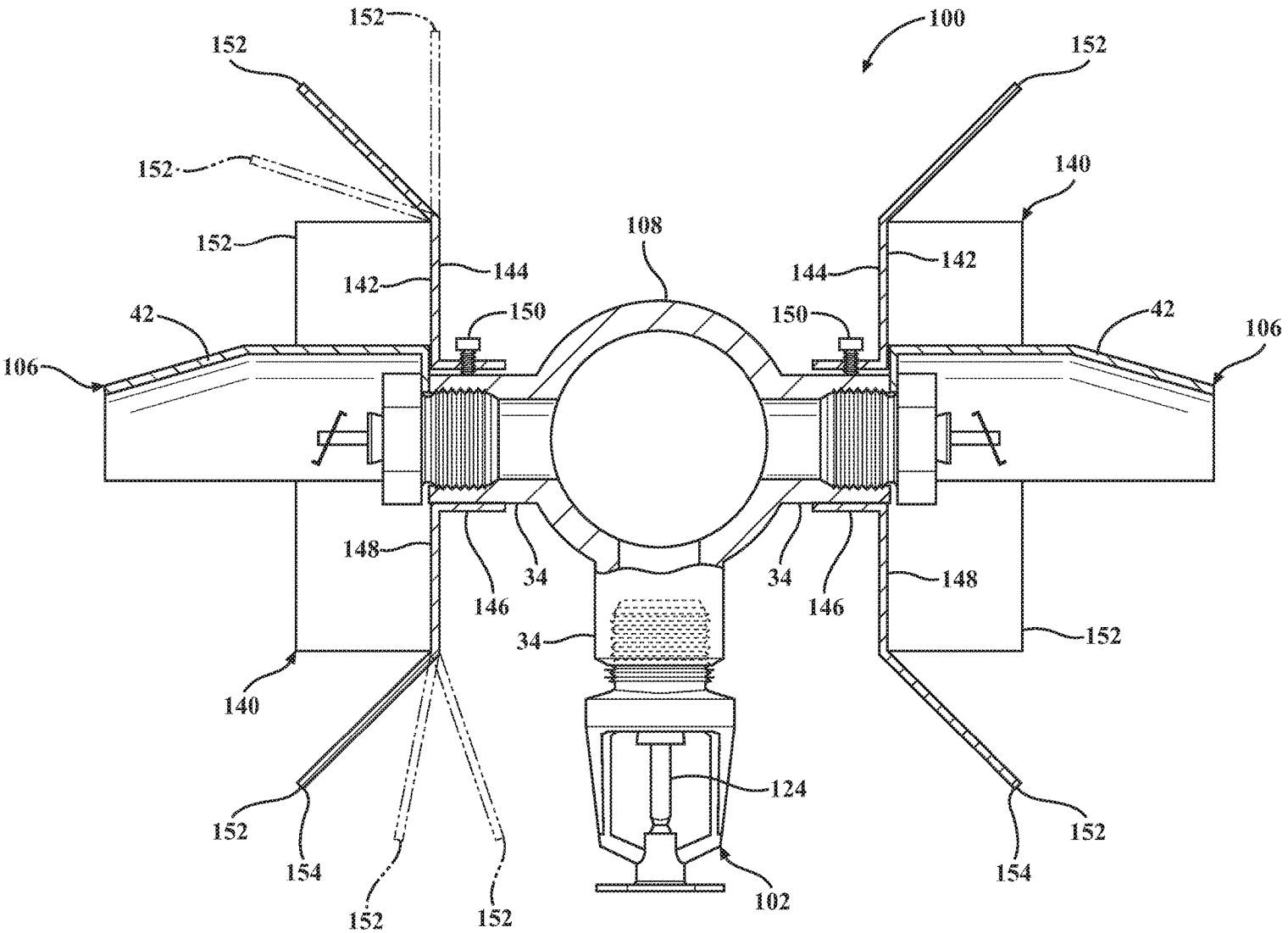
FIG. 25 is cross-sectional view of a three-head array similar to FIG. 21 but showing lateral heat shields operatively associated with each of the right and left side-discharge sprinklers.

FIG. 25 is a cross-section through a three-head array 100 like that described above in connection with FIGS. 11-22. From this perspective, it can be seen that each lateral heat shield 140 is operatively disposed between a respective right or left side-discharge fire sprinkler 106 and the supply line 108 so that its heat-scattering side 144 faces toward the supply line 108. That is to say, each lateral heat shield 140 is associated with one side-discharge fire sprinkler 106, and is oriented so that its heat-concentrating side 142 faces away from the supply line 108.

Attachment of the lateral heat shield 140 is accomplished by a connector, that may take many different ways. In one possible configuration, the connector is a clamp or spring clip (not shown) that functions to directly attach the lateral heat shield 140 to the supply line 108. In another possible configuration, the connector is attached directly to, or otherwise integrated with, the hood 42 of the side-discharge sprinkler 106. However, in the illustrated examples, the connector at least partially surrounds and attaches directly to the respective saddle 34 emanating from the supply line 108 via a collar 146. In this exemplary embodiment, the collar 146 extends axially from a backplate 148 portion of the lateral heat shield 140. The backplate 148 includes an aperture therein that aligns with the collar to receive the saddle 34, after which the side-discharge fire sprinkler 106 is threaded into position. To securely hold the heat shield 140 in place, the collar 146 may include some form of slack take-up device. In the accompanying illustrations, the slack take-up device is shown in the form of set screws 150 threaded through the collar 146 so that their tips press against the saddle 34. However, a slack take-up device could take many other different configurations, including but not limited to resilient self-gripping elements, constricting clamps, jam-nuts, and the like. That is to say, the slack take-up device is not intended to be limited to the set screw 150 configurations shown in the Figures.

Turning again to the shape of the lateral heat shields 140, it bears repeating that many different designs are possible. The boxy flower-like construction shown in the figures is exemplary only but nevertheless merits description. Considering still FIGS. 23-25, the backplate 148 is shown to be of a generally flat construction, however contoured shapes (e.g., parabolic) are possible. Furthermore, the flat backplate 148 is shown having a generally rectangular shape, however other polygonal, curved and mixed curved/straight shapes are possible. A plurality of pedals 152 radiate from the backplate 148—one pedal 148 from each of the four linear edges of the backplate 148. Each pedal 152 is shown as a very simple rectangular shape, but of course other shapes are certainly possible. The Figures also show constructions in which pedals 152 entirely surround the backplate 148. However, in some contemplated embodiments one or more edges of the backplate 148 may be unencumbered with pedals 148. For example, it some applications it may be desirable to omit a pedal 152 along the bottom edge of the backplate 148 to better collect heat energy when a fire is relatively close to the supply line 108.

Because each pedal 152 adjoins the backplate 148 along a generally linear interface, the angle of each pedal 152 could be manipulated as suggested by the phantom lines in FIG. 25 to achieve optimal reflectivity and/or water spray shielding. It is not mandatory that any of the pedals 152 be adjustable, nor indeed that all of the pedals 152 be adjustable. In some contemplated variations, only one or some of the pedals 152 are arcuately adjustable relative to the backplate 148 along the generally linear interface, while the remaining pedal(s) 148 are non-adjustable. Many possibilities exist to achieve optimal results.

The lateral heat shield 140 technology is applicable in two-head array settings like those described in connection with FIGS. 3-10, as well as three-head array 100 applications like those associated with FIGS. 11-22. In three-head array 100 settings, the lateral heat shield 140 offers some additional advantages. In particular, unlike the previous three-head array 100 examples which required use of a heat collector 104 with the vertical discharge sprinkler 102, in the example of FIG. 25 it is possible (but not mandatory) to omit the heat collector 104 in cases whether all three sprinkler heads in the three-head array 100 are axially aligned. That is to say, when the side discharge sprinklers 106 are directly back-to-back and the vertical discharge sprinkler 102 is also aligned as in FIG. 25, the pedals 152 that extend downwardly from the backplate 148 may be configured to sufficiently protect the trigger of the vertical discharge sprinkler 102 against cold soldering. The lower edge 154 of the downwardly extending pedal 152 may be designed to at least partially vertically cover the temperature-sensitive trigger 124 (or fuse) of the vertical-discharge fire sprinkler 102, in which case the heat collector 104 may (optionally) be omitted as shown in FIG. 25. However, if all three sprinkler heads in the three-head array 100 are not axially aligned, then it is likely that the heat collector 104 will be required to protect the temperature-sensitive trigger 124 (or fuse) of the vertical-discharge fire sprinkler 102 against cold-soldering. (See FIG. 27.) And indeed, even if all three sprinkler heads in the array 100 are aligned, it may still be advantageous to include a heat collector 104 for the heat-collecting benefits.

Figure 26:
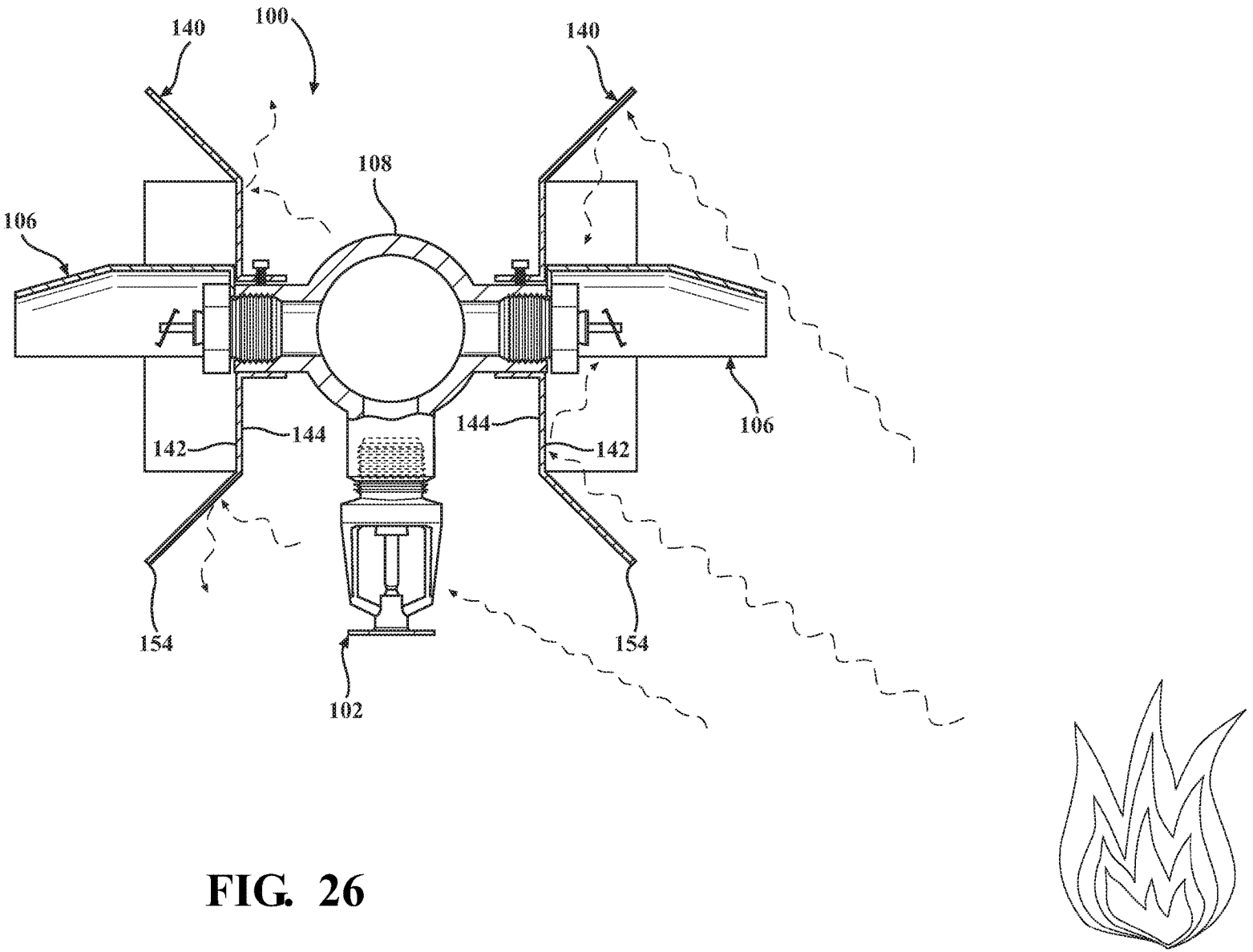
FIG. 26 is a simplified view of the three-head array of FIG. 25 exposed to a laterally-offset fire, and in which the right side-discharge sprinkler is prompted to early activation by the concentrated effects of radiant heat and the left side-discharge sprinkler will experience delayed activation by the scattering of radiant heat.

FIG. 26 is a schematic depiction of the lateral heat shields 140 in operation with respect to a three-head array 100. In this illustration, a fire has emerged at a location spaced laterally from the supply line 108. Radiant heat energy from the fire interacts with the fire sprinkler system. Heat reaches the vertical discharge sprinkler 102 without disruption or interference by the lateral heat shields 140. For the right side-discharge sprinkler 106 closest to the fire, the radiant heat energy encounters the heat-concentrating side 142 of its lateral heat shield 140. The interior surfaces of the pedals 152 and the backplate 148 reflect the radiant heat in a converging manner toward the vicinity of the trigger element in the right side-discharge sprinkler 106 closest to the fire. This concentration of heat provokes the right side-discharge sprinkler 106 to activate quickly in the event of a fire. And, as mentioned, the response time of the vertical discharge sprinkler 102 will proceed in the normal manner. However, for the left side-discharge sprinkler 106 pointed away from the fire, the radiant heat energy will encounter the heat-scatter side 142 of its lateral heat shield 140. The exterior surfaces of the pedals 152 and backplate 148 will reflect the radiant heat in a diverging manner away of the trigger element in the left side-discharge sprinkler 106. This dispersion of heat retards activation of the left side-discharge sprinkler 106, whose water spray would be of little-to-no value given the location of the fire.

Figure 27:
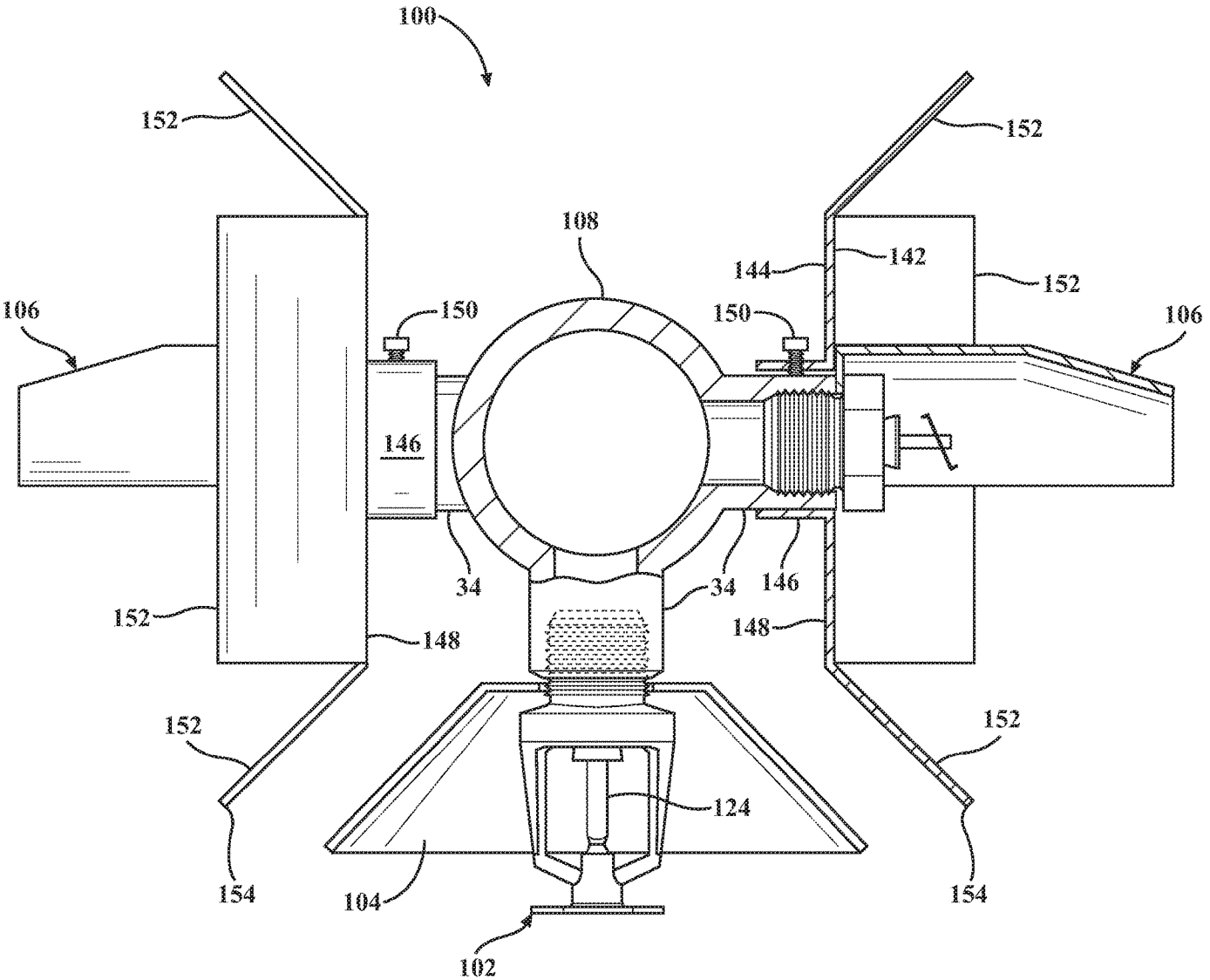
FIG. 27 is cross-sectional view as in FIG. 25, but where the left side-discharge sprinkler is axially offset from the right side-discharge sprinkler, and the vertical discharge sprinkler is provided with a heat collector.

FIG. 27 is a view as in FIG. 25 but showing the left and right side-discharge sprinklers 106 axially offset from one another. The vertical discharge sprinkler 102 in this case is fitted with a heat collector 104 to protect against cold-soldering.

Figure 28:
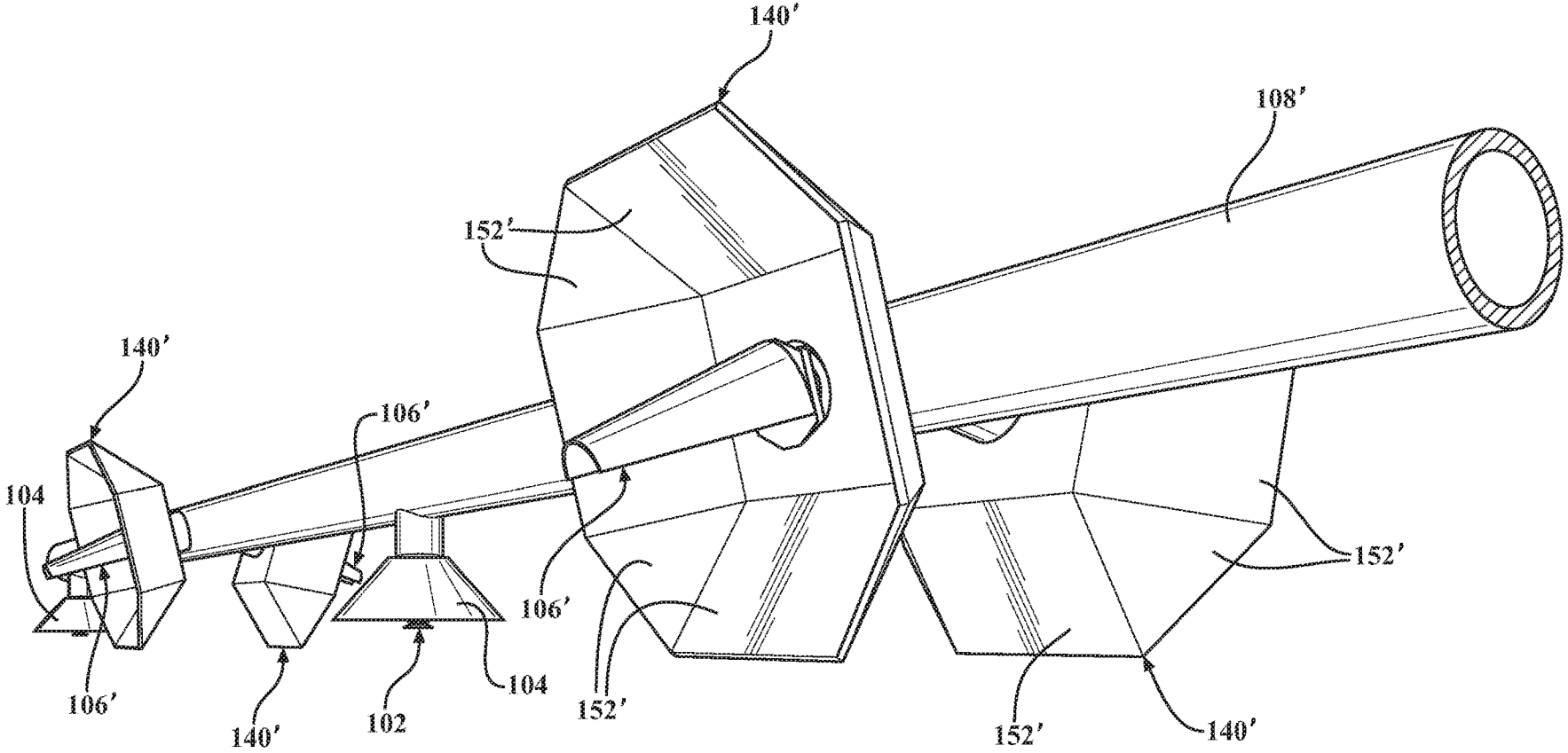
FIG. 28 is a fragmentary perspective view of an alternative embodiment wherein two three-head arrays are supported along a common supply line, with the side-discharge sprinklers set at downwardly skewed angles and the lateral heat shields are configured with fused pedals to create dish-like reflection surfaces.

FIG. 28 is yet another alternative embodiment demonstrating further contemplated variations. In this example, the pedals 152' of each lateral heat shield 140' are fused to more efficiently reflect radiant heat from a fire. Although the pedals 152' appear here as multi-faceted dishes, it will be understood that many variations are possible, including smoothly curving frusto-conical bells similar to the heat collectors 140' as well as almost any imaginable asymmetrical structure having suitable concave and convex features.

Another notable feature of the FIG. 28 embodiment is the downwardly angled side-discharge sprinklers 106'. The saddles associated with the side-discharge sprinklers 106' have been attached to the supply line 108' at skewed angels to achieve a desired coverage area for a similar purpose to that of the embodiment of FIG. 10. Of course, the angularly adjustable design of the FIG. 10 embodiment could also be implemented with any of the lateral heat shield 140, 140' embodiments to enable in-the-field setting of coverage areas.

Figure 29:
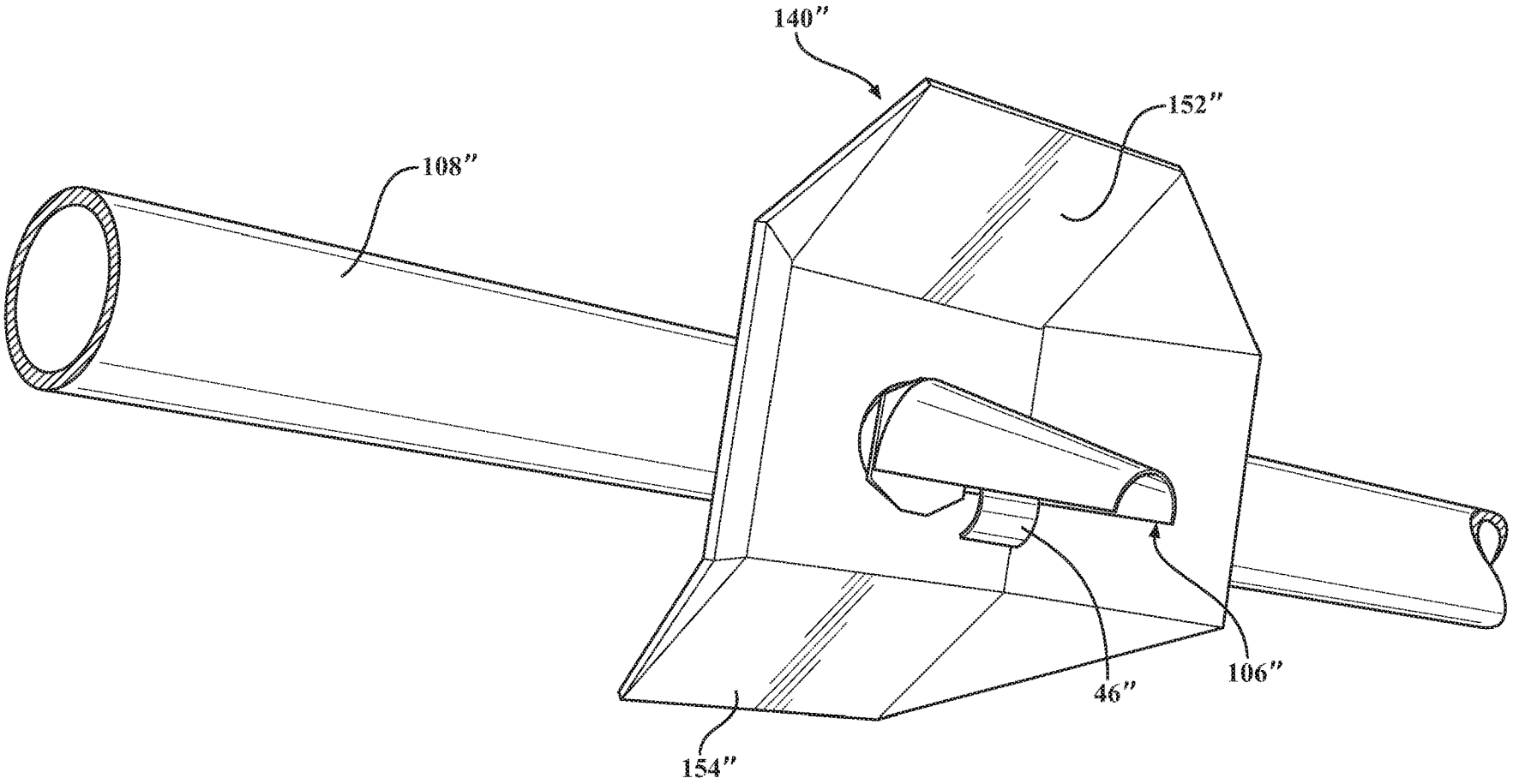
FIG. 29 is yet another alternative embodiment of the lateral heat shield configured to facilitate controlled downspray without sacrificing heat reflection properties.

FIG. 29 shows another alternative embodiment in which the pedals 152" of each lateral heat shield 140" are shaped to facilitate controlled back-spray in combination with the aforementioned heat reflection properties. In this view, the sprinkler 106" includes a downwash deflector 46" like that described above in connection with FIGS. 3-10 to exemplify applications in which there is intentional rearward distribution of the sprayed water. This figure demonstrates the adaptability of the lateral heat shield 140" to two-head arrays, as well as three-head arrays, when additional downwash and/or overlap in the coverage area below the supply line 108" is desired. The lower edge 154" of the pedals 152" is shown back-swept to help evenly distribute sprayed water below the supply line 108". The back-sweep of the lower edge is also suggested in phantom in FIG. 25 and can likewise be used to shield a pendent sprinkler (not shown) from cold-soldering spray. As with most features of this invention, the shapes of the lateral heat shield 140" and the downwash deflector 46" be modified to achieve a well-defined coverage area with the desired water density distribution characteristics, and without sacrificing the many benefits afforded by the lateral heat shield technology.

The lateral heat shields 140 of FIGS. 23-29 have numerous benefits. Perhaps foremost, the lateral heat shields 140 allow better control of the side-discharge sprinklers 106 needed to fight a laterally-offset fire, because the limited water supply is less likely to be shared with the side-discharge sprinkler 106 that is pointing away from the fire. The water pressure required to adequately fight the fire will be maximized in the direction of the fire because the system will not be taxed by unwanted discharging heads pointing in unproductive directions. Also, use of lateral heat shields 140 allows more economical pipe sizing. This is a subtle but compelling fact that saves both labor and material costs. With reductions in labor and material costs, competition in the marketplace will be enhanced because smaller installer operations we be able to bid for large jobs that would otherwise require too much working capital. Furthermore, because water pressure will be maximized in the direction of the fire, the activated sprinkler heads will produce greater water travel distances and greater water velocity for extinguishment. That is, the coverage area of the activated spray heads will be larger and more effective because the system will not be taxed by unwanted discharging heads. Thus, the system hydraulics will be improved because the lateral heat shields 140 enable better discharge control. When lateral heat shields 140 are combined with a multi-head sprinkler array (both two-head and three-head configurations), the best of fire sprinkler principles can be achieved, yielding a fire sprinkler system capable of delivering more control of sensitivity.

The foregoing invention has been described in accordance with the relevant legal standards, thus the description is exemplary rather than limiting in nature. Variations and modifications to the disclosed embodiment may become apparent to those skilled in the art and fall within the scope of the invention. For example, the lateral heat shields 140 of FIGS. 23-28 and/or the angular adjustability configurations of FIG. 10 could be integrated into any of the embodiments described in FIGS. 11-22, and vise-versa. Furthermore, particular features of one embodiment can replace corresponding features in another embodiment or can supplement other embodiments unless otherwise indicated by the drawings or this specification.

What is claimed is:

1. A method for protecting a storage area with multiple orientations of fire sprinklers, said method comprising the steps of:

identifying elongated narrow flue formations within the storage area through which hot combustion gases will be naturally channeled in the event of fire, the flues being arranged parallel to one another within the storage area, suspending at least one water supply line in the storage area, fluidically connecting a left side-discharge fire sprinkler to the at least one supply line, the left side-discharge fire sprinkler being configured to cast a spray of liquid water exclusively over a non-circular left-side coverage area located substantially laterally to a left side of the side-discharge fire sprinkler, the non-circular left-side coverage area being defined by a major diameter (L2) and a shorter minor diameter (W2), positioning the left side-discharge fire sprinkler so that the major diameter (L2) of its noncircular left-side coverage area is parallel to and overlaps at least one flue, further including the step of fluidically connecting a right side-discharge fire sprinkler to the at least one supply line, the right side-discharge fire sprinkler being configured to cast a spray of liquid water exclusively over a non-circular right-side coverage area located substantially laterally to a right side of the right side-discharge fire sprinkler, the non-circular right side coverage area being defined by a major diameter (L2) and a shorter minor diameter (W2), positioning the right side-discharge fire sprinkler so that the major diameter (L2) is parallel to and overlaps at least one flue, fluidically connecting a vertical-discharge fire sprinkler to the at least one supply line, the vertical-discharge fire sprinkler being configured to cast a spray of liquid water exclusively over a vertical coverage area located substantially below the vertical-discharge fire sprinkler, locating the vertical-discharge fire sprinkler adjacent the left side-discharge fire sprinkler so that the vertical coverage area overlaps the non-circular left-side coverage area, and wherein said locating step further includes locating the vertical-discharge fire sprinkler adjacent the right side-discharge fire sprinkler so that the vertical coverage area overlaps the non-circular right-side coverage area, whereby when concurrently activated the left side-discharge fire sprinkler and right-side discharge fire sprinkler and vertical-discharge fire sprinkler will cast overlapping sprays of water to form a combined multi-orientation wetting zone.

2. The method of claim 1 wherein the vertical coverage area is circular.

3. The method of claim 1 wherein the vertical coverage area is non-circular.

4. The method of claim 1 wherein said arranging step includes axially aligning the right side-discharge fire sprinkler with the left side-discharge fire sprinkler.

5. The method of claim 1 wherein said arranging step includes axially offsetting the right side-discharge fire sprinkler with the left side-discharge fire sprinkler.

6. The method of claim 1 wherein said locating step includes axially offsetting the vertical-discharge fire sprinkler from at least one of the left side-discharge fire sprinkler and right-side discharge fire sprinkler.

7. The method of claim 1 further including the step of concentrating heat from an underlying fire toward the vertical-discharge fire sprinkler.

8. The method of claim 7 wherein said step of concentrating heat includes converging the heat within a generally frusto-conical shroud.

9. The method of claim 1 further including the step of moving liquid water through a plurality of supply lines arranged parallel to one another.

* * * * *